US009854658B2

(12) United States Patent
Iwamoto et al.

(10) Patent No.: US 9,854,658 B2
(45) Date of Patent: Dec. 26, 2017

(54) EXTREME ULTRAVIOLET LIGHT GENERATION APPARATUS

(71) Applicant: Gigaphoton Inc., Tochigi-ken (JP)

(72) Inventors: Fumio Iwamoto, Oyama (JP); Masaki Nakano, Oyama (JP); Tsukasa Hori, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/152,124

(22) Filed: May 11, 2016

(65) Prior Publication Data

US 2016/0255709 A1 Sep. 1, 2016

Related U.S. Application Data

(63) Continuation of application No. PCT/JP2013/085184, filed on Dec. 27, 2013.

(51) Int. Cl.
*H05G 2/00* (2006.01)

(52) U.S. Cl.
CPC ..... *H05G 2/008* (2013.01); *H05G 2/003* (2013.01); *H05G 2/005* (2013.01); *H05G 2/006* (2013.01)

(58) Field of Classification Search
CPC ..... H05G 2/008; H05G 2/003; H05G 2/005; H05G 2/006
USPC ..... 250/493.1, 504 R
See application file for complete search history.

(56) References Cited

U.S. PATENT DOCUMENTS 7,872,245 B2 1/2011 Vaschenko et al.
8,138,487 B2 3/2012 Vaschenko et al.
2009/0224181 A1 9/2009 Abe et al.
2009/0230326 A1 9/2009 Vaschenko et al.
2010/0097593 A1 4/2010 Murakami
2010/0213395 A1 8/2010 Ueno et al.
2010/0231130 A1 9/2010 Labetski et al.
2010/0258748 A1 10/2010 Vaschenko et al.
2010/0258749 A1 10/2010 Partlo et al.
2010/0258750 A1 10/2010 Partlo et al.
2012/0057680 A1 3/2012 Hemberg et al.
2012/0119116 A1* 5/2012 Kakizaki ..... G03F 7/70033 250/504 R (Continued)

FOREIGN PATENT DOCUMENTS

JP 2008-078031 A 4/2008
JP 2009-218323 9/2009

(Continued)

OTHER PUBLICATIONS

International Search Report issued in PCT/JP2013/085184; dated Apr. 28, 2014.

(Continued)

*Primary Examiner* — Nicole Ippolito
(74) *Attorney, Agent, or Firm* — Studebaker & Brackett PC

(57) ABSTRACT

An extreme ultraviolet light generation apparatus may include: a chamber in which extreme ultraviolet light is generated when a target is irradiated with a laser beam inside the chamber; a target supply part configured to supply the target into the chamber; and a target collector configured to collect the target which is supplied by the target supply part but is not irradiated with the laser beam in a collection container, by receiving the target on a receiving surface having a contact angle of equal to or smaller than 90 degrees with the target.

17 Claims, 21 Drawing Sheets

(56) References Cited

U.S. PATENT DOCUMENTS

| | | | | |
|---|---|---|---|---|
| 2012/0205559 | A1 | 8/2012 | Yabu et al. | |
| 2012/0217422 | A1 | 8/2012 | Yabu et al. | |
| 2012/0248343 | A1 | 10/2012 | Nagai et al. | |
| 2013/0134326 | A1 | 5/2013 | Yabu et al. | |
| 2016/0192470 | A1* | 6/2016 | Iwamoto ..... | G03F 7/70908 250/504 R |

FOREIGN PATENT DOCUMENTS

| | | | |
|---|---|---|---|
| JP | 2010-171405 | A | 8/2010 |
| JP | 2010-212685 | | 9/2010 |
| JP | 2011-023712 | A | 2/2011 |
| JP | 2011-514648 | | 5/2011 |
| JP | 2012-523666 | A | 10/2012 |
| JP | 2012-212654 | | 11/2012 |
| JP | 2013-084892 | A | 5/2013 |
| JP | 2013-131483 | A | 7/2013 |
| WO | 2010/112048 | A1 | 10/2010 |

OTHER PUBLICATIONS

Written Opinion issued in PCT/JP2013/085184; dated Apr. 28, 2014.

International Search Report (PCT/ISA/210) dated Jan. 28, 2014, which issued in PCT/JP2013/079092 and corresponds to related U.S. Appl. No. 15/062,896, filed Mar. 7, 2016, 5 pp.

Written Opinion (PCT/ISA/237) dated Jan. 28, 2014, which issued in PCT/JP2013/079092 and corresponds to related U.S. Appl. No. 15/062,896, filed Mar. 7, 2016, 7 pp.

An Office Action; "Notification of Reasons for Refusal," mailed by the Japanese Patent Office dated Sep. 19, 2017, which corresponds to Japanese Patent Application No. 2015-544628 and is related to U.S. Appl. Nos. 15/062,896 and 15/152,124; with English Translation.

* cited by examiner

| MATERIAL | CONTACT ANGLE(° ) |
|---|---|
| ALUMINIUM | 43 |
| COPPER | 64 |
| STAINLESS STEEL (SUS316) | 78 |
| SILICON | 79 |
| NICKEL | 80 |
| TITANIUM | 89 |
| MOLYBDENUM (WITH VACUUM HEAT TREATMENT) | 30～70 |
| SILICON CARBIDE | 123～150 |
| SILICON NITRIDE | 140～168 |
| ALUMINIUM OXIDE | 163 |
| ZIRCONIUM OXIDE | 140～153 |
| GRAPHITE | 149 |
| DIAMOND | 125～135 |
| SILICON OXIDE | 120～150 |
| MOLYBDENUM OXIDE (WITHOUT VACUUM HEAT TREATMENT) | 120～130 |

*FIG.7*

EXTREME ULTRAVIOLET LIGHT GENERATION APPARATUS

CROSS-REFERENCES TO RELATED APPLICATIONS

This application claims the benefit of International Patent Application No. PCT/JP2013/085184 filed Dec. 27, 2013, which is incorporated herein by reference.

BACKGROUND

1. Technical Field

The present disclosure relates to an EUV (extreme ultraviolet) light generation apparatus.

2. Related Art

In recent years, as semiconductor processes become finer, transfer patterns for use in photolithographies of semiconductor processes have rapidly become finer. In the next generation, microfabrication at 70 nm to 45 nm, further, microfabrication at 32 nm or less would be demanded. In order to meet the demand for microfabrication at 32 nm or less, for example, it is expected to develop an exposure device in which a system for generating EUV light at a wavelength of approximately 13 nm is combined with a reduced projection reflective optical system.

Three types of EUV light generation systems have been proposed, which include an LPP (laser produced plasma) type system using plasma generated by irradiating a target material with a laser beam, a DPP (discharge produced plasma) type system using plasma generated by electric discharge, and an SR (synchrotron radiation) type system using synchrotron orbital radiation.

CITATION LIST

Patent Literature

PTL1: U.S. Pat. No. 7,872,245

PTL2: U.S. Pat. No. 8,138,487

PTL3: U.S. Patent Application Publication No. 2012/0205559

SUMMARY

According to a first aspect of the present disclosure, an extreme ultraviolet light generation apparatus may include: a chamber in which extreme ultraviolet light is generated when target is irradiated with a laser beam inside the chamber; a target supply part configured to supply the target into the chamber; and a target collector configured to collect the target which is supplied by the target supply part but is not irradiated with the laser beam in a collection container, by receiving the target on a receiving surface having a contact angle of equal to or smaller than 90 degrees with the target.

According to a second aspect of the present disclosure, an extreme ultraviolet light generation apparatus may include: a chamber in which extreme ultraviolet light is generated when a target is irradiated with a laser beam inside the chamber; a target supply part configured to supply the target into the chamber; and a target collector including a filter configured to allow the target which is supplied by the target supply part but is not irradiated with the laser beam to pass therethrough.

BRIEF DESCRIPTION OF THE DRAWINGS

Hereinafter, selected embodiments of the present disclosure will be described with reference to the accompanying drawings by way of example.

FIG. 7 shows contact angles of various materials with molten tin;

DESCRIPTION OF EXEMPLARY EMBODIMENTS

<Contents>

Figure 1:
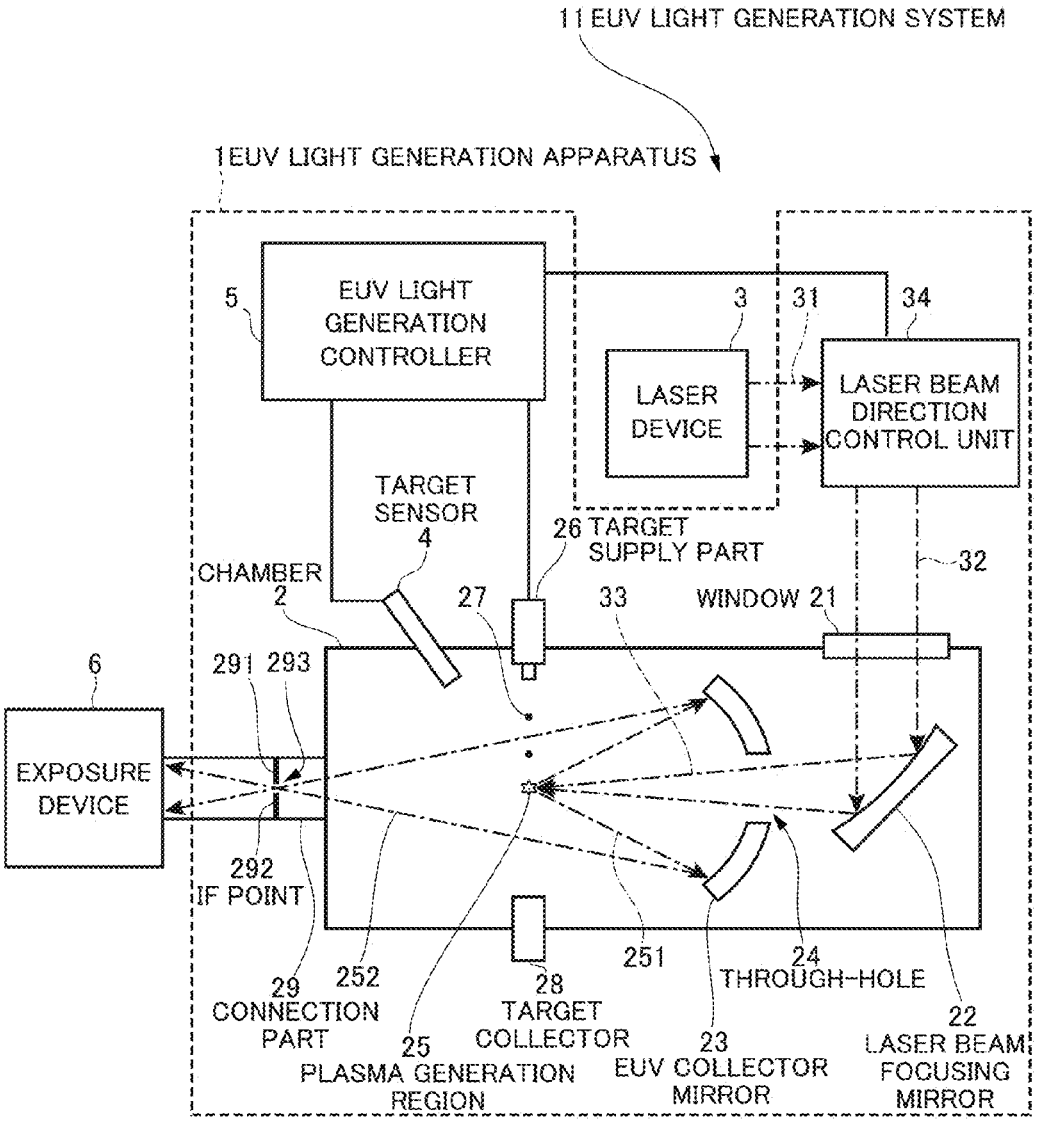
FIG. 1 schematically shows the configuration of an exemplary LPP type EUV light generation system.

1. Overview
2. Description of terms
3. Overview of the EUV light generation system
3.1 Configuration
3.2 Operation
4. EUV light generation apparatus including a target collector
4.1 Configuration
4.2 Operation
4.3 Problem
5. Target collector of the EUV light generation apparatus acoording to Embodiment 1
5.1 First example of the target collector
6. Target collector of the EUV light generation apparatus according to Embodiment 2
6.1 Second example of the target collector
6.2 Third example of the target collector
6.3 Fourth example of the target collector
6.4 Fifth example of the target collector
7. Target collector of the EUV light generation apparatus according to Embodiment 3
7.1 Sixth example of the target collector
7.2 Seventh example of the target collector
7.3 Eighth example of the target collector
7.4 Ninth example of the target collector
7.5 Tenth example of the target collector
8. Other examples of filter installation
9. Others
9.1 Hardware environment of each controller
9.2 Modification Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Corresponding elements may be referenced by corresponding reference numerals and characters, and therefore duplicate descriptions will be omitted.

1. Overview

The present disclosure may at least disclose the following embodiments.

The EUV light generation apparatus 1 according to the present disclosure may include: a chamber 2 in which EUV light 252 is generated when a target 27 is irradiated with a pulsed laser beam 33 inside the chamber; a target supply part 26 configured to supply the target 27 into the chamber 2; and a target collector 28 configured to collect the target 27 which is supplied by the target supply part 26 but is not irradiated with the pulsed laser beam 33 in a collection container 281, by receiving the target 27 on a receiving surface S having a contact angle of equal to or smaller than 90 degrees with the target. Therefore, the EUV light generation apparatus 1 according to the present disclosure can prevent the fragmented materials 274 of the target 27 from dispersing to the outside of the target collector 28, when the target 27 not irradiated with the pulsed laser beam 33 is collected.

The EUV light generation apparatus 1 according to the present disclosure may include: a chamber 2 in which EUV light 252 is generated when a target 27 is irradiated with a pulsed laser beam 33 inside the chamber 2; a target supply part 26 configured to supply the target 27 into the chamber 2; and a target collector 28 including a filter 288 configured to allow the target 27 which is supplied by the target supply part 26 but is not irradiated with the pulsed laser beam 33 to pass therethrough. Therefore, the EUV light generation apparatus 1 according to the present disclosure can prevent the fragmented materials 274 of the target 27 from dispersing to the outside of the target collector 28, when the target 27 not irradiated with the pulsed laser beam 33 is collected.

2. Description of Terms

"Target" refers to a substance which is introduced into the chamber and is irradiated with a laser beam. The target irradiated with the laser beam is turned into plasma and emits EUV light. "Droplet" refers to one form of the target introduced into the chamber.

3. Overview of the EUV Light Generation System

3.1 Configuration

FIG. 1 schematically shows the configuration of an exemplary LPP type EUV light generation system. The EUV light generation apparatus 1 may be used with at least one laser device 3. In the present disclosure, the system including the EUV light generation apparatus 1 and the laser device 3 may be referred to as an EUV light generation system 11. As shown in FIG. 1, and as described in detail later, the EUV light generation apparatus 1 may include the chamber 2 and the target supply part 26. The chamber 2 may be sealed airtight. The target supply part 26 may be mounted onto the chamber 2, for example, to penetrate a wall of the chamber 2. A target material to be supplied from the target supply part 26 may include, but is not limited to, tin, terbium, gadolinium, lithium, xenon, or a combination of any two or more of them.

The chamber 2 may have at least one through-hole in its wall. A window 21 may be provided on the through-hole. A pulsed laser beam 32 outputted from the laser device 3 may transmit through the window 21. In the chamber 2, an EUV collector mirror 23 having a spheroidal reflective surface may be provided. The EUV collector mirror 23 may have a first focusing point and a second focusing point. The surface of the EUV collector mirror 23 may have a multi-layered reflective film in which molybdenum layers and silicon layers are alternately laminated. Preferably, the EUV collector mirror 23 may be arranged such that the first focusing point is positioned in a plasma generation region 25 and the second focusing point is positioned in an intermediate focusing (IF) point 292. The EUV collector mirror 23 may have a through-hole 24 formed at the center thereof so that a pulsed laser beam 33 may pass through the through-hole 24.

The EUV light generation apparatus 1 may further include an EUV light generation controller 5 and a target sensor 4. The target sensor 4 may have an imaging function and detect the presence, trajectory, position and speed of the target 27.

Further, the EUV light generation apparatus 1 may include a connection part 29 that allows the interior of the chamber 2 to be in communication with the interior of an exposure device 6. In the connection part 29, a wall 291 having an aperture 293 may be provided. The wall 291 may be positioned such that the second focusing point of the EUV collector mirror 23 lies in the aperture 293.

The EUV light generation apparatus 1 may also include a laser beam direction control unit 34, a laser beam focusing mirror 22, and the target collector 28 for collecting the target 27. The laser beam direction control unit 34 may include an optical element for defining the traveling direction of the laser beam and an actuator for adjusting, for example, the position and the posture of the optical element.

3.2 Operation

With reference to FIG. 1, a pulsed laser beam 31 outputted from the laser device 3 may pass through the laser beam direction control unit 34, transmit through the window 21 as a pulsed laser beam 32, and then enter the chamber 2. The pulsed laser beam 32 may travel through the chamber 2 along at least one laser beam path, be reflected from the laser beam focusing mirror 22, and be applied to at least one target 27 as the pulsed laser beam 33.

The target supply part 26 may be configured to output the target 27 to the plasma generation region 25 in the chamber 2. The target 27 may be irradiated with at least one pulse of the pulsed laser beam 33. Upon being irradiated with the pulsed laser beam, the target 27 may be turned into plasma, and EUV light 251 may be emitted from the plasma together with the emission of light at different wavelengths. The EUV light 251 may be selectively reflected from the EUV collector mirror 23. EUV light 252 reflected from the EUV collector mirror 23 may be focused onto the IF point 292, and outputted to the exposure device 6. Here, one target 27 may be irradiated with multiple pulses of the pulsed laser beam 33.

The EUV light generation controller 5 may be configured to totally control the EUV light generation system 11. The EUV light generation controller 5 may be configured to process the image data of the target 27 captured by the target sensor 4. Further, the EUV light generation controller 5 may be configured to control at least one of: the timing at which the target 27 is outputted; and the direction in which the target 27 is outputted. Furthermore, the EUV light generation controller 5 may be configured to control at least one of: the timing at which the laser device 3 oscillates; the traveling direction of the pulsed laser beam 32; and the position on which the pulsed laser beam 33 is focused. The various controls described above are merely examples, and other controls may be added as necessary.

Figure 2:
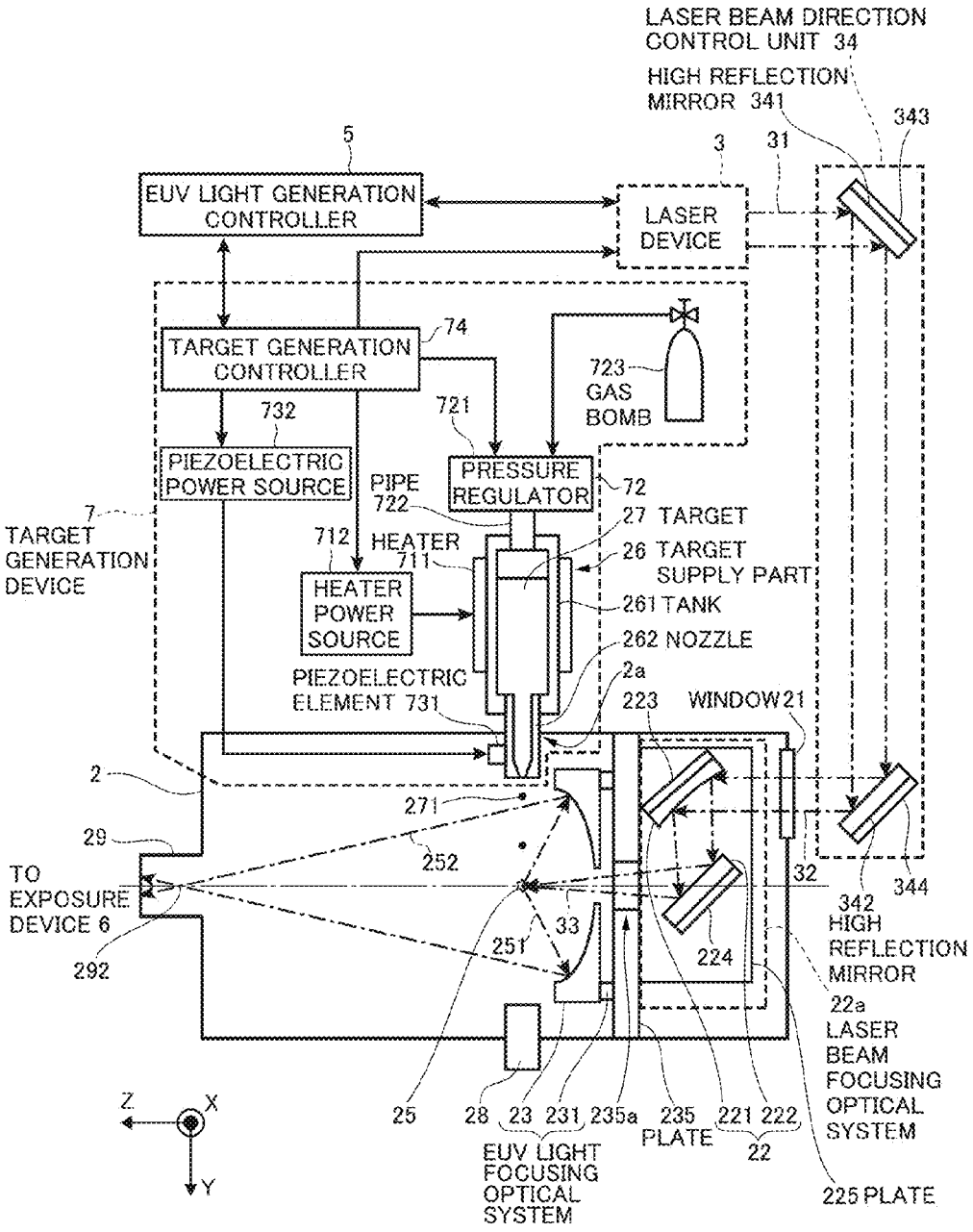
FIG. 2 shows the configuration of an EUV light generation apparatus including a target generation device.
Figure 3:
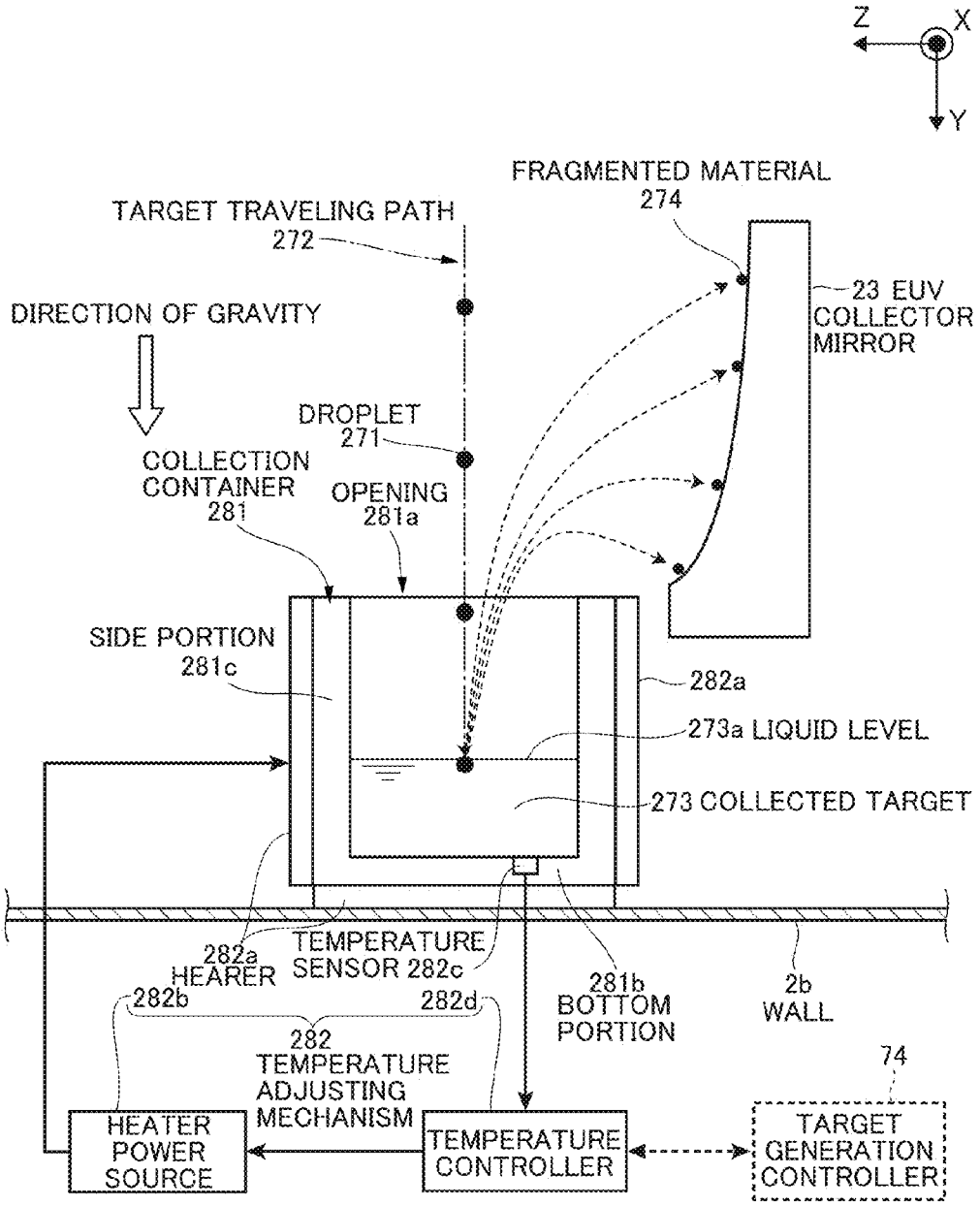
FIG. 3 shows the configuration of a target collector.

4. EUV Light Generation Apparatus Including the Target Collector 4.1 Configuration With reference to FIGS. 2 and 3, the configuration of the EUV light generation apparatus 1 including a target generation device 7 and the target collector 28 will be described. FIG. 2 shows the configuration of the EUV light generation apparatus 1 including the target generation device 7. FIG. 3 shows the configuration of the target collector 28. In FIG. 2, the direction in which the EUV light 252 is outputted from the chamber 2 of the EUV light generation apparatus 1 to the exposure device 6 is defined as a Z-axis. An X-axis and a Y-axis are orthogonal to the Z-axis and are orthogonal to one another. The same applies to the subsequent drawings.

The chamber 2 of the EUV light generation apparatus 1 may be formed in, for example, a hollow spherical shape or a hollow cylindrical shape. The direction of the central axis of the cylindrical chamber 2 may be the same as the direction in which the EUV light 252 is outputted to the exposure device 6.

The cylindrical chamber 2 may include a target supply hole 2*a* formed in its side portion, for supplying the target 27 into the chamber 2 from the outside of the chamber 2. If the chamber 2 is formed in a hollow spherical shape, the target supply hole 2*a* may be formed on the wall surface of the chamber 2 at a position in which the window 21 and the connection part 29 are not provided.

In the chamber 2, a laser beam focusing optical system 22*a*, an EUV light focusing optical system 23*a*, the target collector 28, a plate 225 and a plate 235 may be provided.

The plate 235 may be fixed to the inner surface of the chamber 2. A hole 235*a* that allows the pulsed laser beam 33 to pass therethrough may be formed at the center of the plate 235 in the thickness direction of the plate 235. The opening direction of the hole 235*a* may be the same as the direction of the axis passing through the through-hole 24 and the plasma generation region 25 shown in FIG. 1. The EUV light focusing optical system 23*a* may be provided on one surface of the plate 235. Meanwhile, on the other surface of the plate 235, the plate 225 may be provided via a triaxial stage (not shown).

The EUV light focusing optical system. 23*a* provided on the one surface of the plate 235 may include the EUV collector mirror 23 and a holder 231. The holder 231 may hold the EUV collector mirror 23. The holder 231 holding the EUV collector mirror 23 may be fixed to the plate 235.

The plate 225 provided on the other surface of the plate 235 may be changed in its position and posture by the triaxial stage. The laser beam focusing optical system 22*a* may be provided on the plate 225.

The laser beam focusing optical system 22*a* may include the laser beam collector mirror 22, a holder 223 and a holder 224. The laser beam collector mirror 22 may include an off-axis paraboloidal mirror 221 and a plane mirror 222.

The holder 223 may hold the off-axis paraboloidal mirror 221. The holder 223 holding the off-axis paraboloidal mirror 221 may be fixed to the plate 225. The holder 224 may hold the plane mirror 222. The holder 224 holding the plane mirror 222 may be fixed to the plate 225.

The off-axis paraboloidal mirror 221 may be placed to face each of the window 21 provided on the bottom portion of the chamber 2 and the plane mirror 222. The plane mirror 222 may be placed to face each of the hole 235*a* and the off-axis paraboloidal mirror 221. The positions and postures of the off-axis paraboloidal mirror 221 and the plane mirror 222 may be adjusted by changing the position and posture of the plate 225. This adjustment may be performed such that the pulsed laser beam 33, which is a reflected beam of the pulsed laser beam 32 having entered the off-axis paraboloidal mirror 221 and the plane mirror 222, is focused on the plasma generation region 25.

The target collector 28 may be provided on the lateral side of the chamber 2. The target collector 28 may be disposed on the extension of a target traveling path 272 through which the target 27 outputted into the chamber 2 as a droplet 271 travels. As shown in FIG. 3, the target collector 28 may include a collection container 281 and a temperature adjusting mechanism 282. Here, the configurations of the collection container 281 and the temperature adjusting mechanism 282 will be described in detail later with reference to FIG. 3.

Meanwhile, the laser beam direction control unit 34, the EUV light generation controller 5 and the target generation device 7 may be provided outside the chamber 2.

The laser beam direction control unit 34 may be provided between the window 21 formed on the bottom portion of the chamber 2 and the laser device 3. The laser beam direction control unit 34 may include a high reflection mirror 341, a high reflection mirror 342, a holder 343 and a holder 344.

The holder 343 may hold the high reflection mirror 341. The holder 344 may hold the high reflection mirror 342. The positions and postures of the holders 343 and 344 may be changed by an actuator (not shown) connected to the EUV light generation controller 5.

The high reflection mirror 341 may be placed to face each of the exit aperture of the laser device 3 from which the pulsed laser beam 31 exits and the high reflection mirror 342. The high reflection mirror 342 may be placed to face each of the window 21 of the chamber 2 and the high reflection mirror 341. The positions and postures of the high reflection mirrors 341 and 342 may be adjusted by changing the positions and postures of the holders 343 and 344 by the EUV light generation controller 5. This adjustment may be performed such that the pulsed laser beam 32, which is the reflected beam of the pulsed laser beam 31 having entered the high reflection mirrors 341 and 342, transmits through the window 21 formed in the bottom portion of the chamber 2.

The EUV light generation controller 5 may send/receive control signals to/from the laser device 3 and control the operation of the laser device 3. The EUV light generation controller 5 may send/receive control signals to/from the actuators of the laser beam direction control unit 34 and the laser beam focusing optical system 22*a*. By this means, the EUV light generation controller 5 may adjust the traveling directions and the focusing positions of the pulsed laser beams 31 to 33. The EUV light generation controller 5 may send/receive control signals to/from a target generation controller 74 (described later) of the target generation device 7 and control the operation of the target generation device 7. Here, the hardware configuration of the EUV light generation controller 5 will be described later with reference to FIG. 20.

The target generation device 7 may be provided on the lateral side of the chamber 2. The target generation device 7 may include the target supply part 26, a heater 711, a heater power source 712, a pressure regulator 721, a pipe 722, a gas bomb 723, a piezoelectric element 731, a piezoelectric power source 732, and the target generation controller 74.

The target supply part 26 may include a tank 261 and a nozzle 262. The tank 261 may be formed in a hollow cylindrical shape. The hollow tank 261 may accommodate the target 27. At least the inner surface of the tank 261 accommodating the target 27 may be made of a material which is not easy to react with the target 27. The material which is not easy to react with the target 27 may be any of, for example, silicon carbide, silicon oxide, aluminium oxide, molybdenum, tungsten and tantalum.

The nozzle 262 may be provided on the bottom portion of the cylindrical tank 261. The nozzle 262 may be placed in the interior of the chamber 2 via the target supply hole 2*a* of the chamber 2. The target supply hole 2*a* may be closed by providing the target supply part 26. By this means, it is possible to isolate the interior of the chamber 2 from the atmosphere. The interior of the nozzle 262 may be made of a material which is not easy to react with the target 27.

One end of the pipe-like nozzle 262 may be fixed to the hollow tank 261. A nozzle hole (not shown) may be formed in the other end of the pipe-like nozzle 262. The tank 261 provided on the one end side of the nozzle 262 may be placed outside the chamber 2. Meanwhile, the nozzle hole provided on the other end side of the nozzle 262 may be placed inside the chamber 2. The plasma generation region 25 and the target collector 28 placed inside the chamber 2 may be positioned on the extension of the central axis of the nozzle 262. The interiors of the tank 261, the nozzle 262 and the chamber 2 may communicate with each other. The nozzle hole may be formed in a shape that allows the molten target 27 to be jetted into the chamber 2.

The heater 711 may be fixed to the outer side portion of the cylindrical tank 261. The heater 711 fixed to the tank 261 may heat the tank 261. The heater 711 may be connected to the heater power source 712. The heater power source 712 may supply electric power to the heater 711. The heater power source 712 that supplies electric power to the heater 711 may be connected to the target generation controller 74. The power supply from the heater power source 712 to the heater 711 may be controlled by the target generation controller 74.

A temperature sensor (not shown) may be fixed to the outer side portion of the cylindrical tank 261. The temperature sensor fixed to the tank 261 may be connected to the target generation controller 74. The temperature sensor may detect the temperature of the tank 261 and output a detection signal to the target generation controller 74. The target generation controller 74 may control the electric power supplied to the heater 711 such that the temperature in the tank 261 is a target temperature, based on the detection signal outputted from the temperature sensor. By this means, it is possible to adjust the temperature in the tank 261 to the target temperature.

The pipe 722 may connect between the bottom portion of the cylindrical tank 261 on the opposite side of the nozzle 262 and the pressure regulator 721. The pipe 722 allows the target supply part 26 including the tank 261 and the pressure regulator 721 to communicate with one another. The pipe 722 may be covered with a heat insulating material (not shown). A heater (not shown) may be provided on the pipe 722. The temperature in the pipe 722 may be maintained at the same temperature as the temperature in the tank 261 of the target supply part 26.

The gas bomb 723 may be filled with inert gas such as helium, argon and so forth. The gas bomb 723 may supply the inert gas into the tank 261 via the pressure regulator 721.

The pressure regulator 721 may be provided on the bottom portion of the cylindrical tank 261 on the opposite side of the nozzle 262 via the pipe 722, as described above. The pressure regulator 721 may include solenoid valves for air supply and exhaust, a pressure sensor and so forth. The pressure regulator 721 may detect the pressure in the tank 261 by using the pressure sensor. The pressure regulator 721 may be connected to the gas bomb 723. The pressure regulator 721 may supply inert gas from the gas bomb 723 to the tank 261. The pressure regulator 721 may be connected to an exhaust pump (not shown). The pressure regulator 721 may activate the exhaust pump to discharge the gas from the tank 261. The pressure regulator 721 may increase or decrease the pressure in the tank 261 by supplying/discharging the gas into/out of the tank 261.

The pressure regulator 721 may be connected to the target generation controller 74. The pressure regulator 721 may output a detection signal indicating the detected pressure to the target generation controller 74. A control signal outputted from the target generation controller 74 may be inputted to the pressure regulator 721. The control signal outputted from the target generation controller 74 may be a signal for controlling the operation of the pressure regulator 721 to regulate the pressure in the tank 261 at a target pressure, based on the detection signal outputted from the pressure regulator 721. The pressure regulator 721 may supply/discharge the gas into/out of the tank 261, based on the control signal from the target generation controller 74. By this means, it is possible to regulate the pressure in the tank 261 at the target pressure.

The piezoelectric element 731 may be fixed to the outer side portion of the pipe-like nozzle 262. The piezoelectric element 731 fixed to the nozzle 262 may cause a vibration of the nozzle 262. The piezoelectric element 731 that causes a vibration of the nozzle 262 may be connected to the piezoelectric power source 732. The piezoelectric power source 732 may supply electric power to the piezoelectric element 731. The piezoelectric power source 732 that supplies electric power to the piezoelectric element 731 may be connected to the target generation controller 74. The piezoelectric power source 732 may receive the control signal outputted from the target generation controller 74. The control signal outputted from the target generation controller 74 may be a control signal to cause the piezoelectric power source 732 to supply electric power with a predetermined waveform to the piezoelectric element 731. The piezoelectric power source 732 may supply electric power to the piezoelectric element 731, based on the control signal from the target generation controller 74. The piezoelectric element 731 may cause a vibration of the nozzle 262 according to the predetermined waveform. This allows a standing wave to be given to the flow of the jetted target 27 from the nozzle 262, and therefore it is possible to periodically divide the target 27. The divided target 27 may forma free interface by means of its own surface tension to form a droplet 271.

The target generation controller 74 may send/receive control signals to/from the EUV light generation controller 5 to totally control the entire operation of the target generation device 7. The target generation controller 74 may output a control signal to the heater power source 712 to control the operations of the heater power source 712 and the heater 711. The target generation controller 74 may output a control signal to the pressure regulator 721 to control the operations of the pressure regulator 721 and the gas bomb 723. The target generation controller 74 may output a control signal to the piezoelectric power source 732 to control the operations of the piezoelectric power source 732 and the piezoelectric element 731. The target generation controller 74 may output a control signal to a temperature controller 282*d* (described later) of the temperature adjusting mechanism 282 to control the operation of the temperature adjusting mechanism 282. Here, the hardware configuration of the target generation controller 74 will be described later with reference to FIG. 20.

With reference to FIG. 3, the configuration of the target collector 28 will be described. As described above, the target collector 28 may include the collection container 281 and the temperature adjusting mechanism 282.

The collection container 281 may collect the target 27 outputted into the chamber 2 as the droplet 271. This target 27 may be one of the targets 27 supplied to the plasma generation region 25 by the target supply part 26 but not irradiated with the pulsed laser beam 33. That is, the collection container 281 may collect one of the targets 27 which has been supplied by the target supply part 26 but not contributed to generation of the EUV light 251. The target 27 collected in the collection container 281 may be referred to as "collected target 273."

The collection container 281 may be formed in a cylindrical shape. The central axis of the cylindrical collection container 281 may match the target traveling path 272. An opening 281*a* of the collection container 281 may face the target supply part 26 and the plasma generation region 25. A bottom portion 281*b* of the collection container 281 may be located on the inner surface side of a wall 2*b* of the chamber 2. A side portion 281*c* of the collection container 281 may be provided to extend from the bottom portion 281*b* to the opening 281*a*. The collection container 281 may introduce the target 27 through the opening 281*a* into the inside of the collection container 281 and store the target 27 in space formed by the bottom portion 281*b* and the side portion 281*c*. The collection container 281 may collect the target 27 inside the chamber 2.

The temperature adjusting mechanism 282 may adjust the temperature in the collection container 281. The temperature adjusting mechanism 282 may include a heater 282*a*, a heater power source 282*b*, a temperature sensor 282*c* and the temperature controller 282*d*.

The heater 282*a* may be provided to cover the outer surface of the collection container 281. The heater 282*a* may be fixed to the outer surfaces of the bottom portion 281*b* and the side portion 281*c*. The heater 282*a* fixed to the collection container 281 may heat the collection container 281. The heater 282*a* may be connected to the heater power source 282*b*. The heater power source 282*b* may supply electric power to the heater 282*a*. The heater power source 282*b* that supplies electric power to the heater 282*a* may be connected to the temperature controller 282*d*. The power supply from the heater power source 282*b* to the heater 282*a* may be controlled by the temperature controller 282*d*.

The temperature sensor 282*c* may be fixed to the bottom portion 281*b* or the side portion 281*c* of the collection container 281. The temperature sensor 282*c* may be embedded in and fixed to the inside of the bottom portion 281*b* or the side portion 281*c*. The temperature sensor 282*c* may be fixed to the inner surface of the bottom portion 281*b* or the side portion 281*c*, and directly contact the collected target 273. The temperature sensor 282*c* may be connected to the temperature controller 282*d*. The temperature sensor 282*c* may detect the temperature of the collection container 281 and output a detection signal to the temperature controller 282*d*.

The detection signal outputted from the temperature sensor 282*c* may be inputted to the temperature controller 282*d*. The temperature controller 282*d* may be connected to the target generation controller 74. The temperature controller 282*d* may output the detection signal outputted from the temperature sensor 282*c* to the target generation controller 74. The control signal outputted from the target generation controller 74 may be inputted to the temperature controller 282*d*. The control signal outputted from the target generation controller 74 may be a signal for controlling the operation of the heater power source 282*b* to make the temperature in the collection container 281 be the target temperature, based on the detection signal outputted from the temperature sensor 282*c*. The control signal may contain a temperature setting value to make the temperature in the collection container 281 be the target temperature. The temperature controller 282*d* may control the electric power supplied from the heater power source 282*b* to the heater 282*a*, according to the temperature setting value contained in the control signal from the target generation controller 74. By this means, it is possible to adjust the temperature in the collection container 281 to the target temperature.

The target temperature may be equal to or higher than the melting point of the target 27. When the target 27 is tin, the target temperature may be, for example, equal to or higher than 232 degrees Celsius and lower than 270 degrees Celsius. Alternatively, the target temperature may be equal to or higher than 270 degrees Celsius. The collection container 281 having the temperature adjusted to the target temperature can melt the collected target 273.

4.2 Operation

Figure 4:
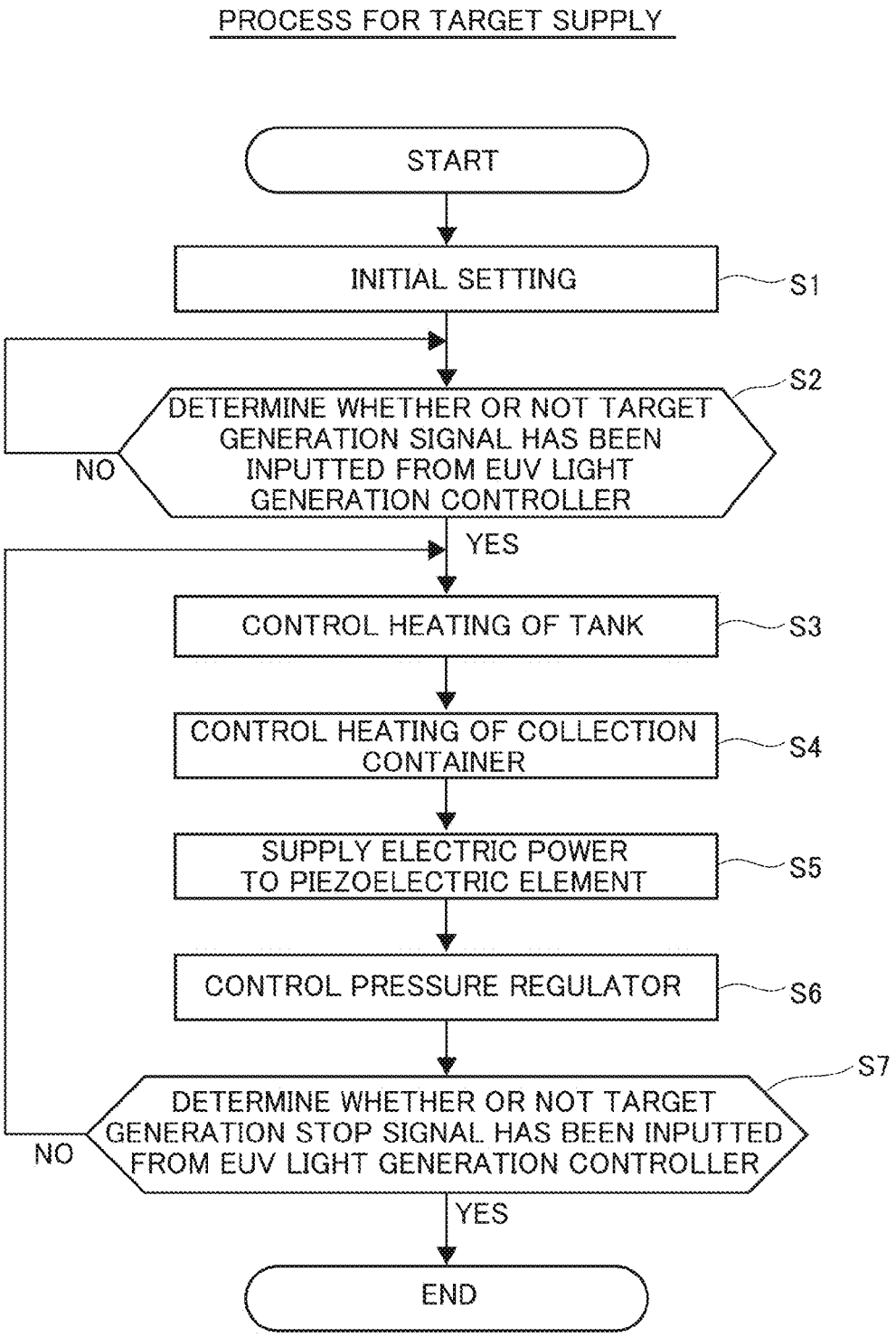
FIG. 4 is a flowchart explaining a process for the target supply performed by a target generation controller.

With reference to FIG. 4, the outline of the operation of the EUV light generation apparatus 1 including the target generation device 7 will be described. FIG. 4 is a flowchart explaining a process for target supply performed by the target generation controller 74. When a start signal to activate the target generation device 7 is inputted from the EUV light generation controller 5 to the target generation controller 74, the target generation controller 74 may perform the following process.

In step S1, the target generation controller 74 may perform initial setting for the target generation device 7. The target generation controller 74 may activate each component of the target generation device 7 and perform operation check on each of the components. Then, the target generation controller 74 may initialize each of the components and set an initial setting value in each of the components.

Particularly, the target generation controller 74 may set an initial pressure setting value of the pressure regulator 721 to make the pressure in the tank 261 have a pressure value approximate to the value of the vacuum state. The pressure value approximate to the value of the vacuum state may be, for example, 1 hPa. The gas in the tank 261, which is easy to react with the target 27, may be discharged before the target 27 has molten. In this case, the inert gas in the gas bomb 723 may be supplied into the tank 261 several times to purge the tank 261.

Moreover, the target generation controller 74 may set an initial temperature setting value of the heater 711 to make the temperature of the target 27 have a value equal to or higher than the melting point of the target 27. The initial temperature setting value of the heater 711 may be, for example, equal to or higher than 232 degrees Celsius and lower than 270 degrees Celsius.

Furthermore, the target generation controller 74 may cause the temperature controller 282*d* to set an initial temperature setting value of the heater 282*a* to make the temperature of the collected target 273 have a value equal to or higher than the melting point of the target 27 when the target 27 is collected. The initial temperature setting value of the heater 282*a* may be equal to or higher than 232 degrees Celsius and lower than 270 degrees Celsius.

In step S2, the target generation controller 74 may determine whether or not a target generation signal has been inputted from the EUV light generation controller 5. The target generation signal may be a control signal to cause the target generation device 7 to supply the target 27 to the plasma generation region 25 in the chamber 2. The target generation controller 74 may wait until the target generation signal is inputted. The target generation controller 74 may continuously control the heating by the heater 711 to maintain the temperature in the tank 261 within a predetermined range of temperatures equal to or higher than the melting point of the target 27. The target generation controller 74 may continuously control the heating by the heater 282*a* to maintain the temperature in the collection container 281 within a predetermined range of temperatures equal to or higher than the melting point of the target 27. When determining that the target generation signal has been inputted, the target generation controller 74 may move the step to step S3.

In the step S3, the target generation controller 74 may check the temperature in the tank 261. The target generation controller 74 may appropriately correct the temperature setting value to control the heating by the heater 711. The target 27 stored in the tank 261 may be heated to a temperature equal to or higher than its melting point. The heated target 27 may be molten.

In step S4, the target generation controller 74 may check the temperature of the collection container 281. The target generation controller 74 may cause the temperature controller 282*d* to appropriately correct the temperature setting value to control the heating by the heater 282*a*. The collected target 273 collected in the collection container 281 may be heated to a temperature equal to or higher than its melting point. The heated collected target 273 may be molten.

In step S5, the target generation controller 74 may cause the piezoelectric power source 732 to supply electric power to the piezoelectric element 731. The piezoelectric element 731 may cause a vibration of the nozzle 262. If the molten target 27 is jetted from the nozzle hole, the molten target 27 is divided due to the vibration of the nozzle 262 so that the droplet 271 may be formed. Here, the target generation controller 74 may control the operation of the piezoelectric power source 732 to supply electric power with a predetermined waveform to the piezoelectric element 731. This predetermined waveform may be a waveform with which the droplet 271 is formed at a predetermined generation frequency. The predetermined generation frequency may be, for example, 50 kHz to 100 kHz.

In step S6, the target generation controller 74 may set a pressure setting value in the pressure regulator 721 so that the pressure in the tank 261 allows the target 27 to be supplied. The pressure regulator 721 may regulate the pressure in the tank 261 at the pressure setting value set as above. The pressure at which the target 27 can be supplied may be a pressure at which a constant amount of the molten target 27 jets from the nozzle hole and reaches the plasma generation region 25 at a predetermined speed. The predetermined speed may be, for example, 60 m/s to 100 m/s. The pressure may be applied to the molten target 27 in the tank 261. The target 27 under pressure may flow from the tank 261 to the nozzle 262, and a constant amount of the target 27 may be jetted from the nozzle hole. The constant amount of the target 27 jetted from the nozzle hole may be vibrated by the piezoelectric element 731 for a constant cycle, so that it is possible to form the uniform droplet 271 for the constant cycle. The formed droplets 271 may be outputted into the chamber 2. The diameter of the formed droplet 271 may be, for example, 20 μm to 30 μm.

The EUV light generation controller 5 may control the timing at which the pulsed laser beam 31 is outputted from the laser device 3 such that the pulsed laser beam 33 is emitted to the plasma generation region 25 at the same time at which the droplet 271 reaches the plasma generation region 25. The droplet 271 reaching the plasma generation region 25 may be irradiated with the pulsed laser beam 33 being emitted to the plasma generation region 25. The droplet 271 irradiated with the pulsed laser beam 33 may be turned into plasma and generate the EUV light 251.

Meanwhile, the droplet 271 not irradiated with the pulsed laser beam 33 may travel on the target traveling path 272 through the plasma generation region 25 and reach the target collector 28. The droplet having reached the target collector 28 may enter the opening 281*a* of the collection container 281 and be stored in the collection container 281. In this case, the temperature of the collection container 281 may be maintained within a predetermined range of temperatures equal to or higher than the melting point of the target 27. Therefore, the droplet 271 having entered the collection container 281 may be stored in the collection container 281, as the molten collected target 273.

In step S7, the target generation controller 74 may determine whether or not a target generation stop signal has been inputted from the EUV light generation controller 5. The target generation stop signal may be a control signal to cause the target generation controller 7 to stop supplying the target 27 to the plasma generation region 25. When determining that the target generation stop signal has not been inputted, the target generation controller 74 may move the step to the step S3. On the other hand, when determining that the target generation stop signal has been inputted, the target generation controller 74 may end this process.

4.3 Problem

The EUV light generation apparatus 1 can supply the target 27 as a plurality of droplets 271 to the plasma generation region 25. The EUV light generation apparatus 1 irradiates the target 27 reaching the plasma generation region 25 with the pulsed laser beam 33 to turn the target 27 into plasma, so that the EUV light 251 can be generated. However, the EUV light generation apparatus 1 may not necessarily irradiate all the targets 27 reaching the plasma generation region 25, with the pulsed laser beam 33. The targets 27 not irradiated with the pulsed laser beam 33 can be collected by the target collector 28. When the target 27 not irradiated with the pulsed laser beam 33 is collected by the target collector 28, the target 27 may enter the collection container 281 through the opening 281*a*.

At this time, the target 27 having entered the target collector 28 may collide against a liquid level 273*a* of the collected target 273 stored in the collection container 281 as shown in FIG. 3. The molten collected target 273 forming the liquid level 273*a* may be broken into splashes by the impact of the collision against the target 27 and jump out as fragmented materials 274. Then, the fragmented materials 274 may pass through the opening 281*a* and disperse to the outside of the target collector 28.

Even when the molten collected target 273 is not stored in the collection container 281, the target 27 having entered the collection container 281 may collide against the bottom portion 281*b* or the side portion 281*c*. When colliding against the bottom portion 281*b* or the side portion 281*c*, the target 27 may be crushed on the surface of the bottom portion 281*b* or the side portion 281*c* and jump out as the fragmented materials 274. Even when the surface of the bottom portion 281*b* or the side portion 281*c* is coated with a material that is not easy to be wetted by the target 27, the crushed target 27 may jump out as the fragmented materials 274. Then, the fragmented materials 274 may pass through the opening 281*a* and disperse to the outside of the target collector 28.

Each of the fragmented materials 274 may be a fine particle having a diameter of about several μm. The fragmented materials 274 may adhere to various optical systems provided in the chamber 2 and thereby deteriorate their performance. In particular, if the fragmented materials 274 adhere to the EUV collector mirror 23 provided in the chamber 2, the reflectivity of the EUV collector mirror 23 may be decreased. The decrease in the reflectivity of the EUV collector mirror 23 may cause power reduction of the EUV light 251, which may cause a problem. Therefore, there is a demand for a technology that can efficiently collect the target 27 not irradiated with the pulsed laser beam 33, while preventing the fragmented materials 274 from dispersing to the outside of the target collector 28.

5. Target Collector of the EUV Light Generation Apparatus According to Embodiment 1

Figure 5:
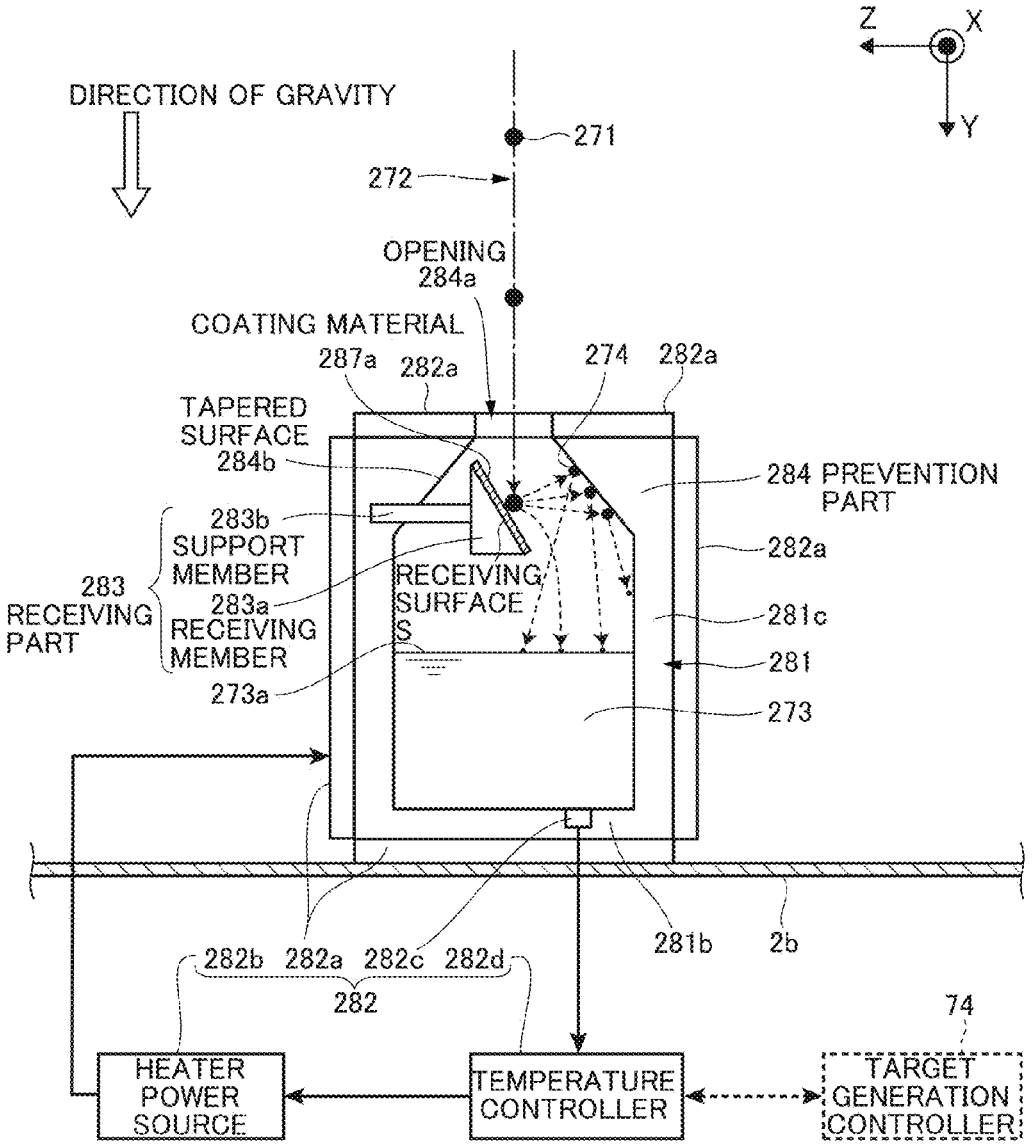
FIG. 5 shows the configuration of a first example of the target collector.
Figure 6:
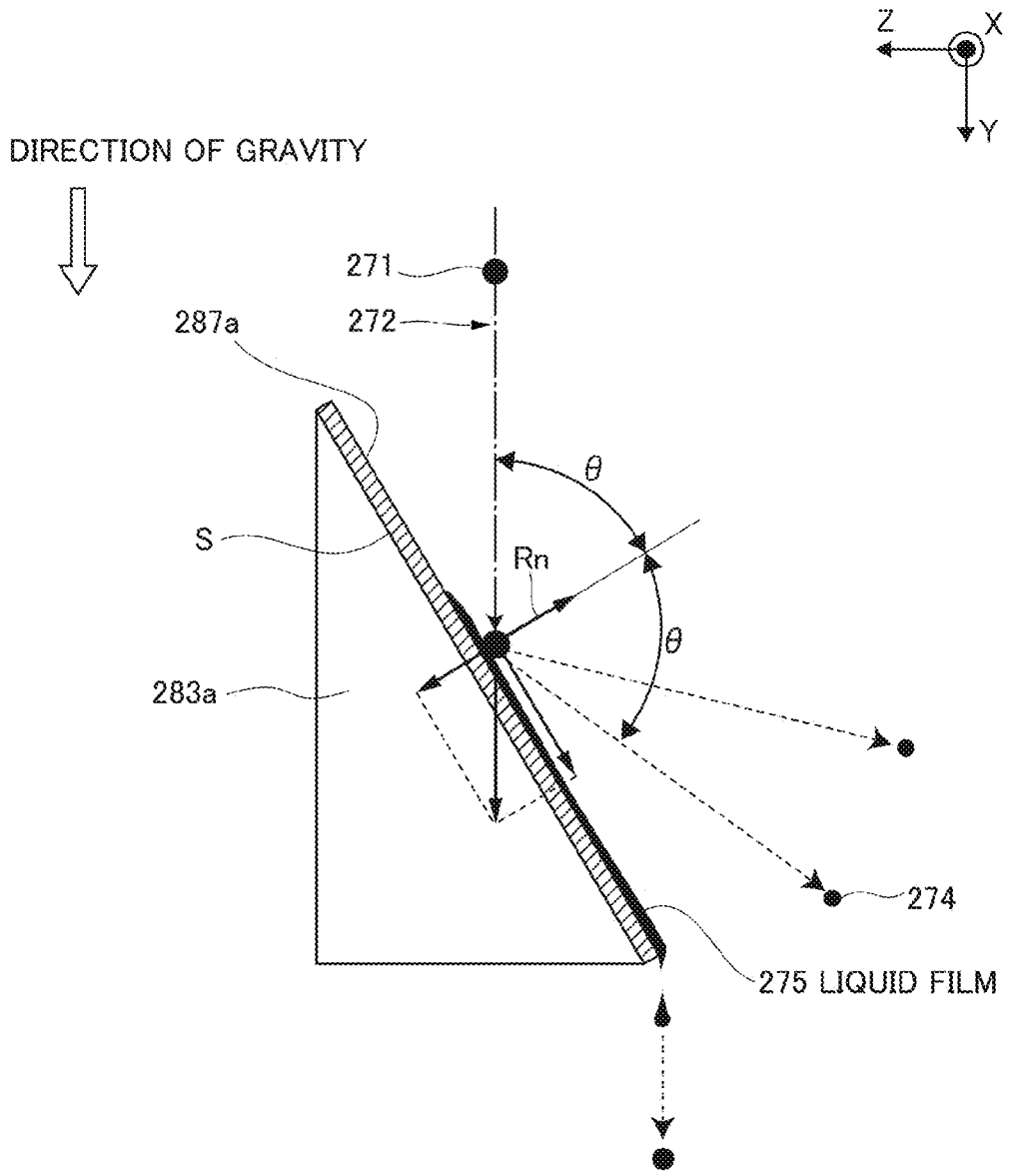
FIG. 6 is a drawing explaining a situation in which a target collides against a receiving surface of a receiving member.

With reference to FIGS. 5 to 7, the target collector 28 of the EUV light generation apparatus 1 according to Embodiment 1 will be described. When collecting the target 27, the target collector 28 of the EUV light generation apparatus 1 according to Embodiment 1 may change the trajectory of the target 27 having entered the target collector 28. In addition, the target collector 28 of the EUV light generation apparatus 1 according to Embodiment 1 may prevent the target 27 entering the target collector 28 from reflecting from the position at which the target 27 collides against the target collector 28 and jumping out. Hereinafter, a first example of the target collector 28 of the EUV light generation apparatus 1 according to Embodiment 1 will be described. The configuration of the target collector 28, which is the same as that of the target collector 28 shown in FIGS. 2 and 3, will not be described again here.

5.1 First Example of the Target Collector

With reference to FIGS. 5 to 7, the configuration of the first example of the target collector 28 will be described. FIG. 5 shows the configuration of the first example of the target collector 28. FIG. 6 is a drawing explaining a situation in which the target collides against a receiving surface S of a receiving member 283*a*. FIG. 7 shows contact angles of various materials with molten tin. As shown in FIG. 5, the first example of the target collector 28 may include the collection container 281, the temperature adjusting mechanism 282, a receiving part 283, and a prevention part 284. The configuration of the first example of the target collector 28 shown in FIG. 5, which is the same as that of the target collector 28 shown in FIG. 3, will not be described again here.

The configuration of the collection container 281 shown in FIG. 5 may be the same as that of the collection container 281 shown in FIG. 3. The configuration of the temperature adjusting mechanism 282 shown in FIG. 5 may be the same as that of the temperature adjusting mechanism 282 shown in FIG. 3.

The receiving part 283 may receive the target 27 having entered the target collector 28. The receiving part 283 may be provided inside the collection container 281. The receiving part 283 may be provided inside the prevention part 284 formed integrally with the collection container 281. The receiving part 283 may include a receiving member 283*a* and a support member 283*b*.

The receiving member 283*a* may be detachably attached to the collection container 281 by the support member 283*b*. The support member 283*b* may be formed integrally with the receiving member 283*a*.

The temperature of the support member 283*b* may be maintained within a predetermined range of temperatures equal to or higher than the melting point of the target 27. As described above, the temperature adjusting mechanism 282 may maintain the temperature in the collection container 281 within a predetermined range of temperatures equal to or higher than the melting point of the target 27. The support member 283*b* fixed to the collection container 281 may be heated by, for example, the heat transfer from the collection container 281, so that the temperature of the support member 283*b* may be maintained within a predetermined range of temperatures equal to or higher than the melting point of the target 27. Also the receiving member 283*a* fixed to the support member 283*b* may be heated by, for example, the heat transfer from the support member 283*b*, so that the temperature of the receiving member 283*a* may be maintained within a predetermined range of temperatures equal to or higher than the melting point of the target 27.

The target 27 having entered the target collector 28 may collide against the receiving member 283*a*, and therefore be received by the receiving member 283*a*. The receiving member 283*a* may include the receiving surface S configured to receive the target 27 having entered the target collector 28.

The receiving surface S of the receiving member 283*a* may be located on the extension of the target traveling path 272. The receiving surface S may be disposed to face the target supply part 26 and the plasma generation region 25.

The receiving part S may be inclined with respect to the target traveling path 272 with a predetermined inclination angle. The inclination angle of the receiving surface S may be provided to prevent the fragmented materials 274 generated by the collision of the target 27 incident on the receiving surface S from dispersing to the outside of the target collector 28. The receiving surface S is provided to incline with the predetermined inclination angle, and therefore can change the trajectory of the target 27 having entered the target collector 28. Here, the situation where the target 27 collides against the receiving surface S of the receiving member 283*a* will be described later with reference to FIG. 6.

The receiving surface S of the receiving member 283*a* may be coated with a coating material 287*a*. The coating material 287*a* may have a contact angle of equal to or smaller than 90 degrees with the liquid target 27. The receiving surface S coated with the coating material 287*a* may be easy to be wetted by the target 27 having entered the target collector 28. Meanwhile, the temperature of the receiving member 283*a* including the receiving surface S may be maintained within a predetermined range of temperatures at least equal to or higher than the melting point of the target 27 as describe above. Therefore, part of the target 27 incident on the receiving surface S may collide against the receiving surface S, and then its form as the droplet 271 may be broken. After that, the target 27 which is the molten target 27 may wet the receiving surface S. A liquid film 275 of the target 27 may be formed on the receiving surface Shaving been wetted by the target 27. Here, the state after the target 27 collides against the receiving surface S will be described later with reference to FIG. 6. Details of the coating material 287*a* will be described later with reference to FIG. 7.

The prevention part 284 may prevent the target 27 having been received by the receiving part 283 from dispersing to the outside of the target collector 28. The prevention part 284 shown in FIG. 5 may prevent the fragmented materials 274 generated by the collision of the target 27 incident on the receiving surface S from dispersing to the outside of the target collector 28. The prevention part 284 may be formed integrally with the collection container 281 as part of the collection container 281. The prevention part 284 may be formed in a cylindrical shape. The central axis of the cylindrical prevention part 284 may match the central axis of the collection container 281. The cylindrical prevention part 284 may be formed to extend from its base end corresponding to the periphery of the opening 281*a* of the collection container 281, toward the target supply part 26 and the plasma generation region 25. The cylindrical prevention part 284 may be formed such that its inside diameter is reduced toward the target supply part 26 and the plasma generation region 25.

The inner periphery of the prevention part 284 may be a tapered surface 284*b* having an inside diameter that is reduced toward the target supply part 26 and the plasma generation region 25. The tapered surface 284*b* may face the bottom portion 281*b* or the side portion 281*c* of the collection container 281. The tapered surface 284*b* may face the receiving surface S of the receiving member 283*a*. The inclination angle of the tapered surface 284*b* with respect to the target traveling path 272 may be equal to or greater than the inclination angle of the receiving surface S with respect to the target traveling path 272. The tapered surface 284*b* may be parallel to the receiving surface S of the receiving member 283*a*. The tapered surface 284*b* may reflect the fragmented materials 274 of the target 27 incident on the receiving surface S toward the bottom portion 281*b* side. By this means, it is possible to prevent the fragmented materials 274 from dispersing to the outside of the target collector 28.

An opening 284*a* may be formed in the leading end of the prevention part 284 located on the target supply part 26 side. The diameter of the opening 284*a* may be sufficiently greater than that of the target 27. The diameter of the opening 284*a* may be, for example, 30 mm. The opening 284*a* may allow the target 27 having entered the target collector 28 to be guided to the receiving member 283*a* of the receiving part 283.

The heater 282*a* of the temperature adjusting mechanism 282 may be fixed to the outer periphery of the prevention part 284. The temperature in the prevention part 284 may be maintained within a predetermined range of temperatures equal to or higher than the melting point of the target 27, by the temperature adjusting mechanism 282.

With reference to FIG. 6, the situation where the target 27 collides against the receiving surface S of the receiving member 283*a* will be described. The target 27 may enter the target collector 28 at an incidence angle θ with respect to the normal direction of the receiving surface S, and collide against the receiving surface S. Upon colliding against the receiving surface S, the target 27 may apply an impact force to the receiving surface S. Meanwhile, the receiving surface S may apply the reaction force of the impact force to the target 27, and this reaction force may break the form of the target 27 as the droplet 271 having collided against the receiving surface S. The crushed target 27 may be separated into the fragmented materials 274 reflected from the receiving surface S and dispersing, and the liquid film 275 covering the receiving surface S.

The fragmented materials 274 reflected from the receiving surface S and dispersing may be a plurality of fine particles. The fragmented materials 274 being the plurality of fine particles may be spread out in a conical shape having the central axis corresponding to the direction of a reflection angle θ which is the same as the incidence angle θ of the target 27. These fragmented materials 274 may be further reflected from the tapered surface 284*b* of the prevention part 284 toward the bottom portion 281*b* side as shown in FIG. 5. The fragmented materials 274 reflected from the tapered surface 284*b* may reach the collection container 281.

The inclination angle of the receiving surface S with respect to the target traveling path 272 may be provided such that the incidence angle θ of the target 27 satisfies $0°<\theta<90°$. A normal component Rn of the reaction force acting on the target 27 colliding against the receiving surface S, which is normal to the receiving surface S (hereinafter referred to simply as "normal component Rn"), may be a driving force for which the target 27 reflected from the receiving surface S disperses as the fragmented materials 274. That is, the normal component Rn may determine the amount and the speed of the dispersion of the fragmented materials 274 generated by the collision of the target 27 against the receiving surface S. When the incidence angle θ of the target 27 is $0°<\theta<90°$, the normal component Rn may be smaller than when the incidence angle θ of the target 27 is $\theta=0°$. Therefore, when the incidence angle θ of the target 27 is $0°<\theta<90°$, it is possible to reduce the amount and the speed of the dispersion of the fragmented materials 274 generated by the collision of the target 27 against the receiving surface S. By this means, it is possible to prevent the fragmented materials 274 of the target 27 from dispersing to the outside of the target collector 28.

In addition, if the inclination angle of the receiving surface S is provided to make the incidence angle θ of the target 27 be θ=0°, the receiving surface S may be orthogonal to the target traveling path 272. Therefore, the fragmented materials 274 generated by the collision of the target 27 against the receiving surface S may not be easy to be reflected from the tapered surface 284*b* of the prevention part 284. Therefore, the fragmented materials 274 may pass through the opening 284*a* and disperse to the outside of the target collector 28.

In addition, if the inclination angle of the receiving surface S is provided to make the incidence angle θ of the target 27 be θ=90°, the receiving surface S may be parallel to the target traveling path 272. Therefore, the target 27 having entered the target collector 28 may not be received by the receiving surface S but collide against the liquid level 273*a* of the collected target 273. The collected target 273 forming the liquid level 273*a* may be broken into splashes by the impact of the collision against the target 27 and jump out as the fragmented materials 274. Then, the fragmented materials 274 may pass through the opening 284*a* and disperse to the outside of the target collector 28.

As described above, it is preferred that the inclination angle of the receiving surface S with respect to the target traveling path 272 is provided to make the incidence angle θ of the target 27 satisfy 0°<θ<90°.

More preferably, the inclination angle of the receiving surface S with respect to the target traveling path 272 may be provided such that the incidence angle θ of the target 27 satisfies 45°<θ<90°. In this case, the normal component Rn may be further reduced. Therefore, it is possible to more effectively reduce the amount and the speed of the dispersion of the fragmented materials 274 generated by the collision of the target 27 against the receiving surface S. As a result, it is possible to prevent the fragmented materials 274 from dispersing to the outside of the target collector 28. In addition, in this case, the inclination angle of the receiving surface S with respect to the target traveling path 272 may be sharper. Therefore, the fragmented materials 274 generated by the collision of the target 27 against the receiving surface S may be easy to disperse to the bottom portion 281*b* side of the collection container 281. In addition, the fragmented materials 274 are easy to be reflected from part of the tapered surface 284*b* of the prevention part 284 on the bottom portion 281*b* side. Then, the fragmented materials 274 reflected from the part of the tapered surface 284*b* on the bottom portion 281*b* side may be easy to reach the collection container 281. Therefore, it is possible to more effectively prevent the fragmented materials 274 from dispersing to the outside of the target collector 28.

Meanwhile, the liquid film 275 covering the receiving surface S may be formed by wetting the receiving surface S with the molten target 27 crushed by the collision against the receiving surface S. The liquid film 275 may have a surface tension that allows the liquid film 275 to absorb the impact force of the subsequent target 27 incident on the receiving surface S, and catch the subsequent target 27. By this means, the reaction force acting on the subsequent target 27 incident on the receiving surface S may be reduced. Also the normal component Rn may be reduced. Therefore, it is possible to reduce the amount and the speed of the dispersion of the fragmented materials 274 generated by the collision of the subsequent target 27 against the receiving surface S. By this means, it is possible to prevent the fragmented materials 274 from dispersing to the outside of the target collector 28. In addition, even if the subsequent target 27 collides against the receiving surface S so that the fragmented materials 274 are generated, the liquid film 275 may catch the fragmented materials 274 with its own surface tension. Therefore, it is possible to reduce the amount and the speed of the dispersion of the fragmented materials 274 generated by the collision of the subsequent target 27 against the receiving surface S. As a result, it is possible to prevent the fragmented materials 274 from dispersing to the outside of the target collector 28.

The liquid film 275 may melt the caught target 27 and accumulate the molten target 27 therein. When the volume of the liquid film 275 is increased due to the accumulation of the caught target 27, the gravity force acting on the liquid film 275 may be increased. After that, the liquid film 275 cannot stay on the receiving surface S due to the increase in the gravity force acting on the liquid film 275. Then, part of the liquid film 275 may fall toward the bottom portion 281*b* and reach the collection container 281.

With reference to FIG. 7, the coating material 287*a* will be described in detail. FIG. 7 is a table showing contact angles of various materials with molten tin. The table shown in FIG. 7 was made based on "Wettability Technology Handbook—Fundamentals, Measurement valuation, Data" (supervisors: Toshio Ishii, Masumi Koishi, and Mitsuo Tsunoda, published by Technosystem). Generally, a state in which a contact angle α satisfies 0°<α≤90° is referred to as "immersional wetting." In this state, a solid is easy to be wetted by liquid. Under the immersional wetting state, a solid is easy to be immersed into the liquid. Meanwhile, a state in which the contact angle α satisfies 90°<α≤180° is referred to as "adhesional wetting." In this state, a solid is not easy to be wetted by liquid. Under the adhesional wetting state, the liquid in contact with the solid surface is easy to move in the direction of gravity.

The target 27 may be tin. The target 27 entering the target collector 28 may be molten tin formed of the droplet 271. The coating material 287*a* applied to the receiving surface S of the receiving member 283*a* may be a material that is easy to be wetted by molten tin. The material that is easy to be wetted by molten tin may have a contact angle of equal to or smaller than 90 degrees with the target 27.

As shown in FIG. 7, the materials having contact angles of equal to or smaller than 90 degrees with the target 27 may be, for example, aluminium, copper, stainless steel, silicon, nickel, titanium, and molybdenum which has been vacuum heat treated. When molybdenum is vacuum heat treated, the adsorption layer and the oxide layer of its surface may be removed, and therefore the molybdenum may be easy to be wetted by the molten tin.

Here, the materials having a contact angle of equal to or smaller than 90 degrees with the target 27 are not limited to be used as the coating material 287*a* applied to the receiving surface S of the receiving member 283*a*. The materials having a contact angle of equal to or smaller than 90 degrees with the target 27 may be used to form the receiving member 283*a*. In addition, means for making the contact angle of the receiving surface S with the target 27 be equal to or smaller than 90 degrees may not be limited to coating with the coating material 287*a*. For example, the means for making the contact angle of the receiving surface S with the target 27 be equal to or smaller than 90 degrees may be applying of a surface treatment to the receiving surface S.

With the above-described configuration of the first example of the target collector 28, the target 27 having entered the target collector 28 may collide against the receiving surface S of the receiving member 283*a*. The target 27 having collided against the receiving surface S may be crushed and separated into the fragmented materials 274 reflected from the receiving surface S and dispersing, and the liquid film 275 covering the receiving surface S. The fragmented materials 274 reflected from the receiving surface S and dispersing may be further reflected from the tapered surface 284*b* of the prevention part 284 toward the bottom portion 281*b*. The fragmented materials 274 reflected from the tapered surface 284*b* may reach the collection container 281. Meanwhile, the liquid film 275 covering the receiving surface S may catch the subsequent target 27 with its surface tension and accumulate the caught target therein. If the volume of the liquid film 275 is increased, the liquid film 275 may not stay on the receiving surface S due to its own gravity. Then, part of the liquid film 275 may fall toward the bottom portion 281*b* and reach the collection container 281. Therefore, the first example of the target collector 28 can efficiently collect the target 27 entering the target collector 28 while preventing the fragmented materials 274 from dispersing to the outside of the target collector 28.

6. Target Collector of the EUV Light Generation Apparatus According to Embodiment 2

With reference to FIGS. 8 to 12, the target collector 28 of the EUV light generation apparatus 1 according to Embodiment 2 will be described. When the target collector 28 of the EUV light generation apparatus 1 according to Embodiment 2 collects the target 27, it may change the trajectory of the target 27 entering the target collector 28. In addition, the target collector 28 of the EUV light generation apparatus 1 according to Embodiment 2 may prevent the target 27 entering the target collector 28 from being reflected from the position at which the target 27 collides against the target collector 28 and jumping out. Moreover, the target collector 28 of the EUV light generation apparatus 1 according to Embodiment 2 may reduce the kinetic energy of the target 27 before the target 27 entering the target collector 28 is reflected from the position at which the target 27 collides against the target collector 28. Hereinafter, the target collector 28 of the EUV light generation apparatus 1 according to Embodiment 2 will be explained as second to fifth examples of the target collector 28. The configuration of the target collector 28, which is the same as that of the target collector 28 shown in FIGS. 2 and 3, and the first example of the target collector 28 shown in FIGS. 5 and 6, will not be described again here.

6.1 Second Example of the Target Collector

Figure 8:
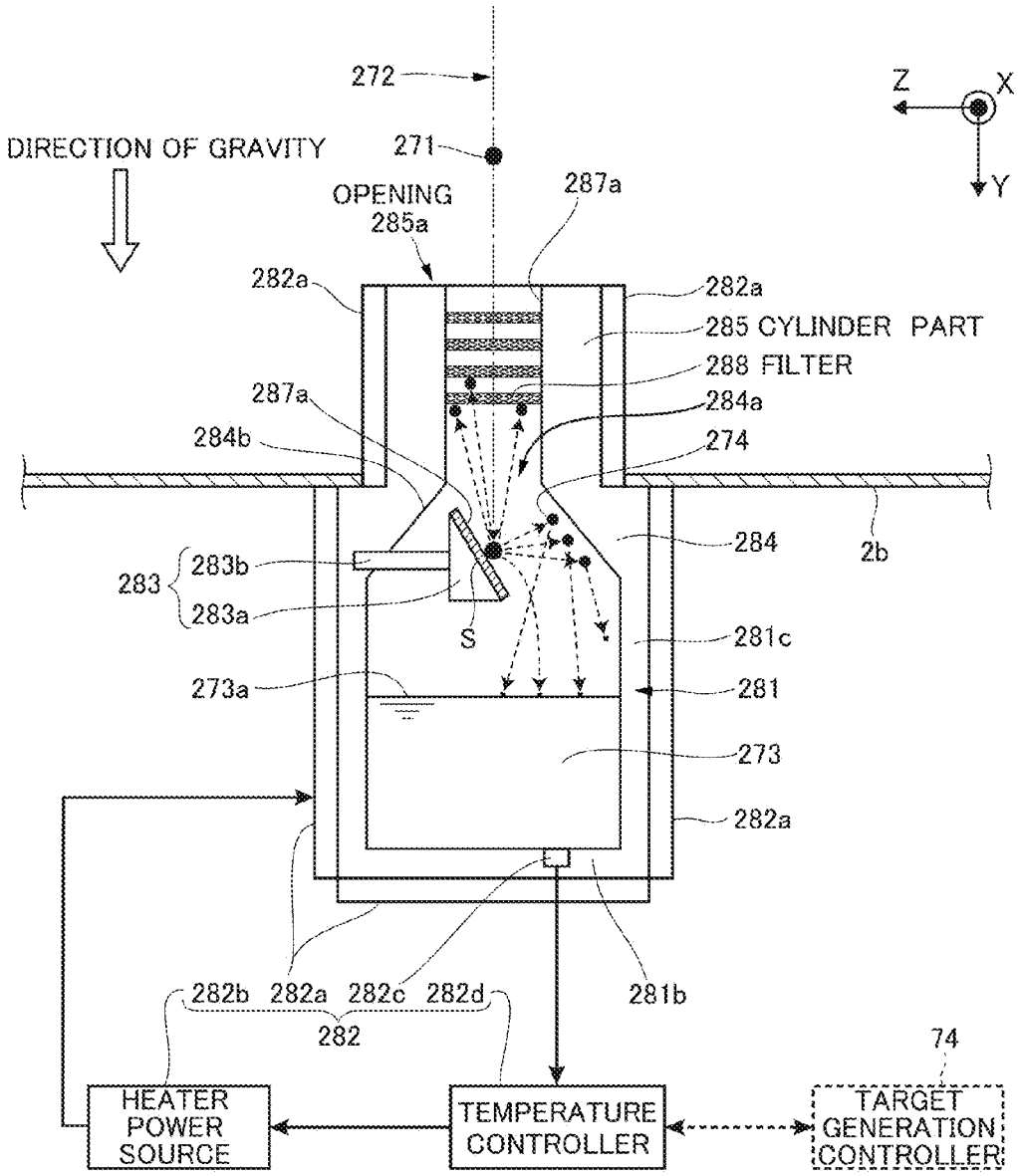
FIG. 8 shows the configuration of a second example of the target collector.

With reference to FIG. 8, the configuration of the second example of the target collector 28 will be described. FIG. 8 shows the configuration of the second example of the target collector. As shown in FIG. 8, the second example of the target collector 28 may include the collection container 281, the temperature adjusting mechanism 282, the receiving part 283, the prevention part 284, a cylinder part 285, and a filter 288.

The configuration of the temperature adjusting mechanism 282 shown in FIG. 8 may be the same as that of the temperature adjusting mechanism 282 shown in FIG. 5. The configuration of the receiving part 283 shown in FIG. 8 may be the same as that of the receiving part 283 shown in FIG. 5. The configuration of the prevention part 284 shown in FIG. 8 may be the same as that of the prevention part 284 shown in FIG. 5.

The collection container 281 shown in FIG. 8 may be disposed outside the chamber 2. The other configuration of the collection container 281 may be the same as the configuration of the collection container 281 shown in FIG. 5.

The cylinder part 285 may guide the target 27 having entered the target collector 28 to the opening 281*a* of the collection container 281 or the opening 284*a* of the prevention part 284. The cylinder part 285 may be disposed inside the chamber 2. The cylinder part 285 may be formed integrally with the prevention part 284 and the collection container 281. The cylinder part 285 may be formed in a cylindrical shape. The central axis of the cylindrical cylinder part 285 may match the central axis of the collection container 281 and the target traveling path 272. The cylindrical cylinder part 285 may be formed to extend from its base end corresponding to the periphery of the opening 284*a* of the prevention part 284, toward the target supply part 26 and the plasma generation region 25.

An opening 285*a* may be provided in the leading end of the cylinder part 285 located on the target supply part 26 side. The diameter of the opening 285*a* may be the same as the diameter of the opening 284*a* of the prevention part 284. The opening 285*a* may introduce the target 27 having entered the target collector 28 into the opening 284*a*. The target 27 introduced into the opening 284*a* may be received by the receiving member 283*a* of the receiving part 283.

The heater 282*a* of the temperature adjusting mechanism 282 may be fixed on the outer periphery of the cylinder part 285. The temperature in the cylinder part 285 may be maintained within a predetermined range of temperatures equal to or higher than the melting point of the target 27.

The filter 288 may allow the target 27 having entered the target collector 28 to pass therethrough. The target 27 may collide against and penetrate the filter 288, so that the filter 288 allows the target 27 to pass therethrough. Here, a situation where the target 27 having entered the target collector 28 passes through the filter 288 will be described later with reference to FIGS. 9A to 9C.

The filter 288 may be held on the inner periphery of the cylinder part 285. The filter 288 may be located closer to the target supply part 26 and the plasma generation region 25 than the receiving surface S of the receiving member 283*a*. The filter 288 may be located on the extension of the target traveling path 272. The filter 288 may be disposed to face the target supply part 26 and the plasma generation region 25. The filter 288 may be disposed to face the receiving surface S of the receiving member 283*a*. The filter 288 may be formed as a circular plate. The central axis of the circular plate-shaped filter 288 may match the central axis of the cylinder part 285.

The filter 288 may be made with a porous metallic plate or wire netting. The porous metallic plate and the wire netting may be made of a material which is easy to react with the target 27. By this means, when the target 27 collides against the filter 288, the filter 288 may be easy to allow the target 27 to penetrate therethrough. The porous metallic plate may be, for example, Celmet (registered trademark). The porous metallic plate may be made of a material, for example, nickel or nickel chrome alloy. The wire netting may be, for example, expanded metal. The wire netting may be made of a material, for example, aluminium, nickel, stainless steel, or copper.

The porous metallic plate or the wire netting constituting the filter 288 may have a large number of openings. The porous metallic plate or the wire netting may have an opening area ratio that prevents the target 27 having entered the target collector 28 from colliding against part of the porous metallic plate or the wire netting except the openings (hereinafter "non-opening portion") many times. The opening area ratio of the porous metallic plate or the wire netting may be, for example, 90%. Here, the opening area ratio may be a ratio of the total area of the openings to the area of the surface of the filter 288 perpendicular to the incident direction of the target 27. The filter 288 made with the porous metallic plate or the wire netting may have a thickness that allows the target 27 having entered the target collector 28 to penetrate the filter 288. When the target 27 having a diameter of, for example, 20 μm collides against the filter 288 at a speed of 60 m/s, the thickness of the filter 288 may be about 100 μm.

The temperature of the filter 288 may be maintained within a predetermined range of temperatures equal to or higher than the melting point of the target 27. As described above, the temperature adjusting mechanism 282 may maintain the temperature in the cylinder part 285 within a predetermined range of temperatures equal to or higher than the melting point of the target 27. The filter 288 held in the cylinder part 285 may be heated by, for example, the heat transfer from the cylinder part 285, so that the temperature of the filter 288 may be maintained within a predetermined range of temperatures equal to or higher than the melting point of the target 27.

As described above, the filter 288 may be made with a porous metallic plate or wire netting having a large number of openings. Therefore, when the gas in the chamber 2 is discharged, the gas in the collection container 281 may flow out into the chamber 2 via the openings of the filter 288 without problem, for example, deformation of the filter 288 due to pressure fluctuation. Then, the gas flowing out of the collection container 281 into the chamber 2 can be discharged. In this case, the fragmented materials 274 can be caught by the filter 288.

Figure 9A:
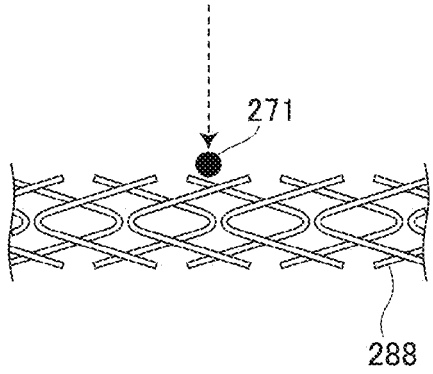
FIG. 9A is a drawing explaining a state before a target passes through the filter shown in FIG. 8.
Figure 9B:
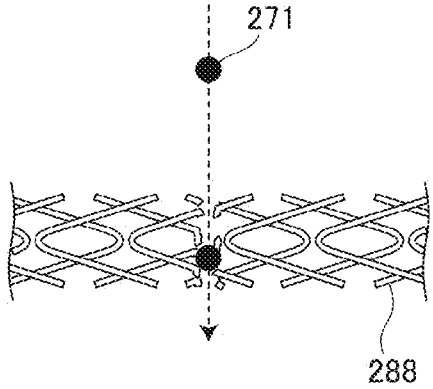
FIG. 9B is a drawing explaining a state when the target passes through the filter shown in FIG. 8.
Figure 9C:
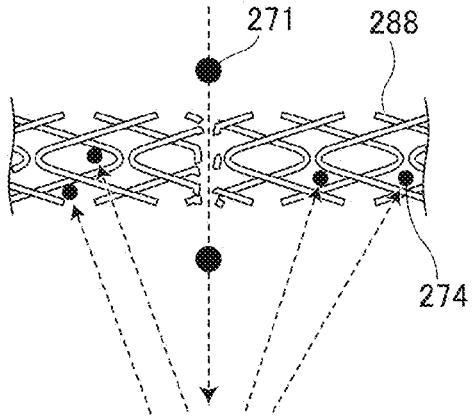
FIG. 9C is a drawing explaining a state of the fragmented materials after the target passes through the filter shown in FIG. 8.

Now, with reference to FIGS. 9A to 9C, the states where the target 27 having entered the target collector 28 passes through the filter 288 will be described. FIG. 9A is a drawing explaining a state before the target 27 passes through the filter 288 shown in FIG. 8. FIG. 9B is a drawing explaining a state when the target 27 passes through the filter 288 shown in FIG. 8. FIG. 9C is a drawing explaining a state of the fragmented materials 274 after the target 27 passes through the filter 288 shown in FIG. 8. As shown in FIG. 9A, the target 27 having entered the target collector 28 may collide against the filter 288 before colliding against the receiving surface S of the receiving member 283*a*.

As described above, the filter 288 may have a thickness that allows the target 27 to penetrate the filter 288. In addition, the filter 288 may have a high opening area ratio that prevents the target 27 from colliding against the non-opening portion of the filter 288 many times. Moreover, the filter 288 may be made of a material which is easy to react with the target 27. Furthermore, the temperature of the filter 288 may be maintained within a predetermined range of temperatures equal to or higher than the melting point of the target 27. Therefore, as shown in FIG. 9B, the target 27 colliding against the filter 288 may penetrate the filter 288 without being crushed on the non-opening portion so that fragmented materials 274 are generated, and without staying in the filter 288. In this case, when the target 27 collides against and penetrates the filter 288, its kinetic energy may be reduced. If a plurality of filters 288 are provided, it is possible to improve the effect of reducing the kinetic energy of the target 27.

After that, the target 27 having penetrated filter 288 may collide against the receiving surface S of the receiving member 283*a*. As described above with reference to FIG. 6, part of the target 27 colliding against the receiving surface S may generate the fragmented materials 274. In this case, since the kinetic energy of the target 27 is reduced, it is possible to more effectively reduce the amount and the speed of the dispersion of the fragmented materials 274 generated by the collision against the receiving surface S.

After that, most of the fragmented materials 274 generated by the collision against the receiving surface S may be reflected from the prevention part 284 toward the bottom portion 281*b* of the collection container 281, and the remaining part of the fragmented materials 274 may disperse to the cylinder part 285. In this case, since the kinetic energy of the target 27 is reduced, it is possible to reduce the ratio of the fragmented materials 274 dispersing to the cylinder part 285, to the fragmented materials 274 generated by the collision against the receiving surface S. Nevertheless, a small percentage of the fragmented materials 274 may disperse to the cylinder part 285. However, as shown in FIG. 9C, the fragmented materials 274 dispersing to the cylinder part 285 may be caught by the filter 288. In this case, if a plurality of filters 288 are provided, it is possible to improve the effect of catching the fragmented materials 274.

Here, the new target 27 may enter the filter 288 which the previous target 27 has already penetrated. This incoming new target 27 may pass through the filter 288 via a through-hole formed by the previous target 27. The kinetic energy of the target 27 passing through the through-hole formed by the previous target 27 may not be reduced. Even in this case, most of the fragmented materials 274 may be reflected from the prevention part 284 and collected in the collection container 281. Meanwhile, a small percentage of the fragmented materials 274 dispersing to the cylinder part 285 may also be caught by the filter 288.

With the above-described configuration, the second example of the target collector 28 can produce the same effect as the first example of the target collector 28. Moreover, with the second example of the target collector 28, the target 27 having entered the target collector 28 can collide against the receiving surface S of the receiving member 283*a* via the filter 288. Therefore, when the target 27 collides against the receiving surface S, the kinetic energy of the target 27 may have been reduced. Accordingly, it is possible to more effectively reduce the amount and the speed of the dispersion of the fragmented materials 274 generated by the collision against the receiving surface S. Furthermore, even though part of the fragmented materials 274 generated by the collision against the receiving surface S disperses to the cylinder part 285, the second example of the target collector 28 can catch these fragmented materials 274 by the filter 288. Therefore, the second example of the target collector 28 can more effectively prevent the fragmented materials 274 from dispersing to the outside of the target collector 28 than the first example of the target collector 28.

6.2 Third Example of the Target Collector

Figure 10:
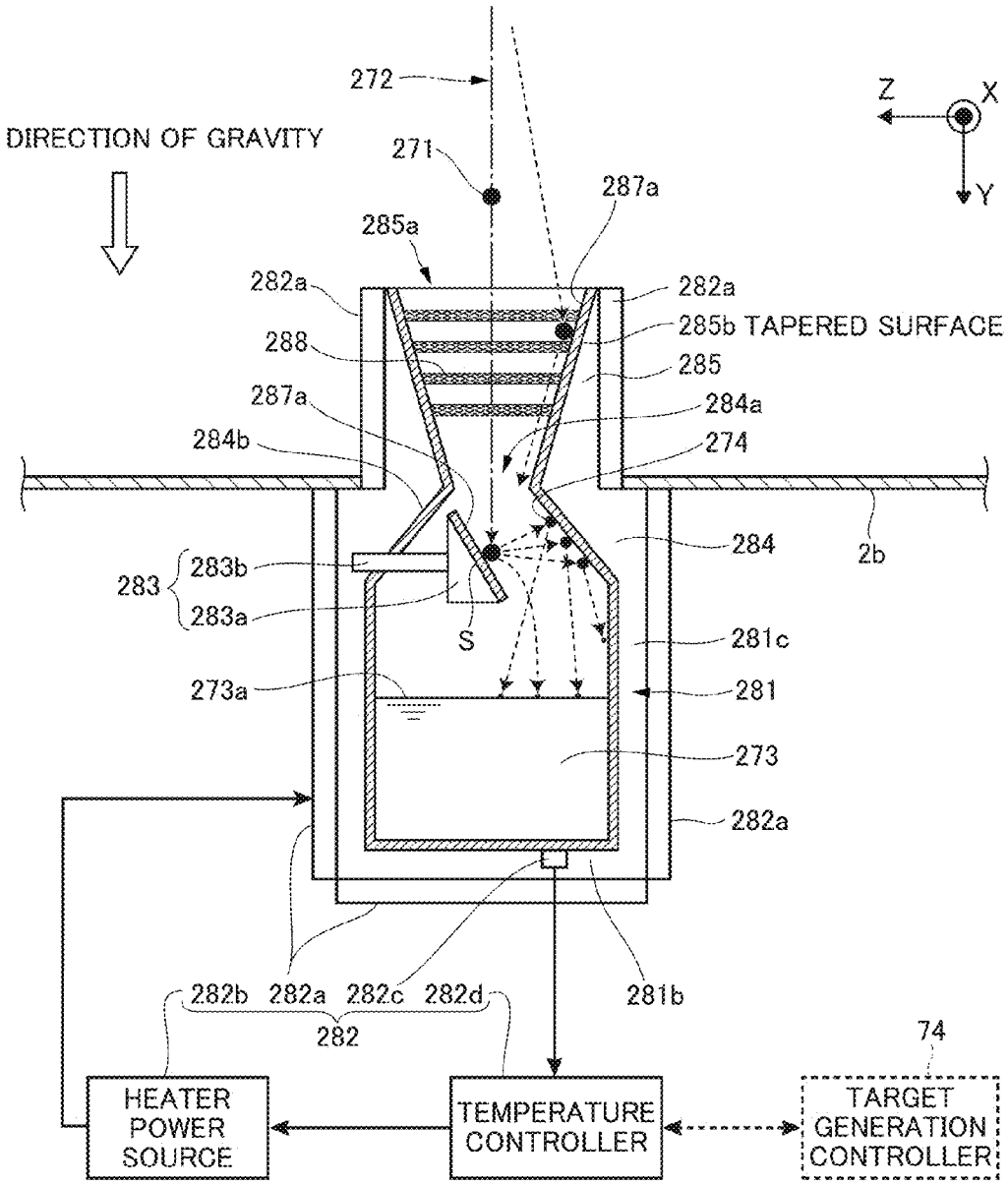
FIG. 10 shows the configuration of a third example of the target collector.

Now, with reference to FIG. 10, the configuration of the third example of the target collector 28 will be described. FIG. 10 shows the configuration of the third example of the target collector. As shown in FIG. 10, the third example of the target collector 28 may include the collection container 281, the temperature adjusting mechanism 282, the receiving part 283, the prevention part 284, the cylinder part 285, and the filter 288. The configuration of the third example of the target collector 28 shown in FIG. 10, which is the same as that of the second example of the target collector 28 shown in FIG. 8, will not be described again here.

The configuration of the temperature adjusting mechanism 282 shown in FIG. 10 may be the same as that of the temperature adjusting mechanism 282 shown in FIG. 8. The configuration of the receiving part 283 shown in FIG. 10 may be the same as that of the receiving part 283 shown in FIG. 8. The configuration of the filter 288 shown in FIG. 10 may be the same as that of the filter 288 shown in FIG. 8.

The inner periphery of the collection container 281 shown in FIG. 10 may be coated with the coating material 287*a*. Alternatively, a surface treatment may be applied to the inner periphery of the collection container 281 to make the contact angle with the target 27 be equal to or smaller than 90 degrees. By this means, upon colliding against the inner periphery of the collection container 281, the fragmented materials 274 may wet the inner periphery. Therefore, it is possible to reduce the amount and the speed of the dispersion of the fragmented materials 274 generated by the collision against the inner periphery of the collection container 281. The other configuration of the collection container 281 may be the same as that of the collection container 281 shown in FIG. 8.

The inner periphery of the prevention part 284 shown in FIG. 10, which is the tapered surface 284*b*, may be coated with the coating material 287*a*. Alternatively, a surface treatment may be applied to the tapered surface 284*b* to make the contact angle with the target 27 be equal to or smaller than 90 degrees. By this means, upon colliding against the tapered surface 284*b*, the fragmented materials 274 may wet the tapered surface 284*b*. Therefore, it is possible to reduce the amount and the speed of the dispersion of the fragmented materials 274 generated by the collision against the tapered surface 284*b*. The other configuration of the prevention part 284 may be the same as that of the prevention part 284 shown in FIG. 8.

The cylinder part 285 shown in FIG. 10 may be formed such that its inside diameter is increased toward the target supply part 26 and the plasma generation region 25. The inner periphery of the cylinder part 285 may be a tapered surface 285*b* having an inside diameter that is increased toward the target supply part 26 and the plasma generation region 25. The tapered surface 285*b* may face the target supply part 26 and the plasma generation region 25. The tapered surface 285*b* may face the receiving surface S of the receiving member 283*a*. The inclination angle of the tapered surface 285*b* with respect to the target traveling path 272 may be equal to or smaller than the inclination angle of the receiving surface S with respect to the target traveling path 272. The tapered surface 285*b* may reflect the target 27 entering the target collector 28 not through the target traveling path 272, toward the opening 284*a* of the prevention part 284 located on the bottom portion 281*b* side. By this means, it is possible to guide the target 27 entering the target collector 28 not through the target traveling path 272, to the opening 284*a* of the prevention part 284.

The tapered surface 285*b* of the cylinder part 285 may be coated with the coating material 287*a*. Alternatively, a surface treatment may be applied to the tapered surface 285*b* to make the contact angle with the target 27 be equal to or smaller than 90 degrees. By this means, when the target 27 entering the target collector 28 not through the target traveling path 272 collides against the tapered surface 285*b*, the target 27 may wet the tapered surface 285*b*. Therefore, it is possible to reduce the amount and the speed of the dispersion of the fragmented materials 274 generated by the collision against the tapered surface 285*b*. The other configuration of the cylinder part 285 may be the same as that of the cylinder part 285 shown in FIG. 8.

With the above-described configuration, the third example of the target collector 28 can produce the same effect as the second example of the target collector 28. Moreover, with the third example of the target collector 28, the target 27 entering the target collector 28 not through the target traveling path 272 may collide against the tapered surface 285*b* of the cylinder part 285. The target 27 colliding against the tapered surface 285*b* may be crushed. The crushed target 27 may be reflected toward the opening 284*a* of the prevention part 284 and wet the tapered surface 285*b*. Therefore, it is possible to collect the target 27 entering the target collector 28 even not through the target traveling path 272 in the collection container 281. In addition, it is possible to reduce the amount and the speed of the dispersion of the fragmented materials 274 generated by the collision of the target 27 against the tapered surface 285*b*. Therefore, the third example of the target collector 28 can more efficiently collect the target 27 having entered the target collector 28, while preventing the fragmented materials 274 from dispersing to the outside of the target collector 28, than the second example of the target collector 28.

6.3 Fourth Example of the Target Collector

Figure 11:
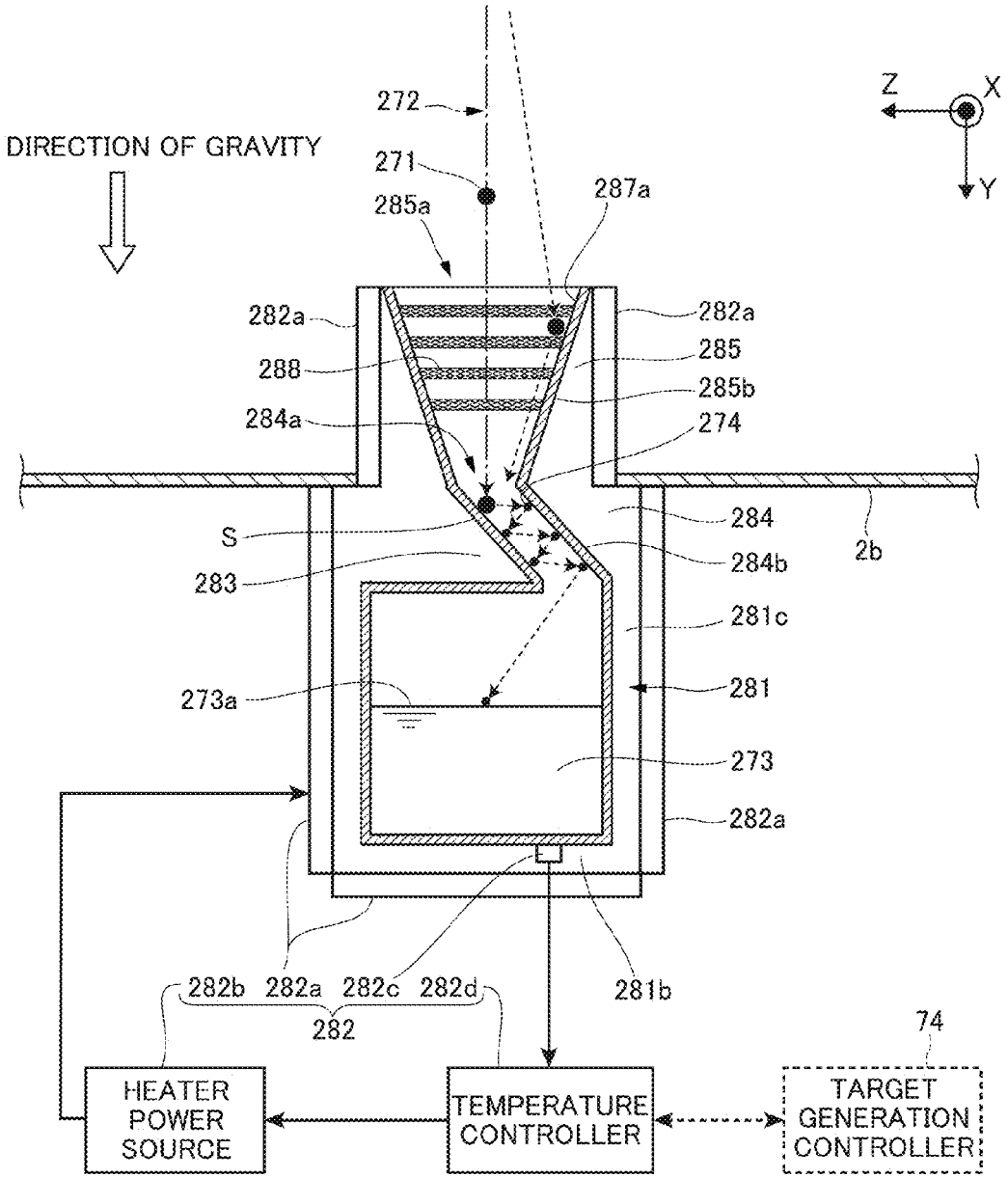
FIG. 11 shows the configuration of a fourth example of the target collector.

Now, with reference to FIG. 11, the configuration of the fourth example of the target collector 28 will be described. FIG. 11 shows the configuration of the fourth example of the target collector. As shown in FIG. 11, the fourth example of the target collector 28 may include the collection container 281, the temperature adjusting mechanism 282, the receiving part 283, the prevention part 284, the cylinder part 285, and the filter 288. The configuration of the fourth example of the target collector 28 shown in FIG. 11, which is the same as that of the third example of the target collector 28 shown in FIG. 10, will not be described again here.

The configuration of the collection container 281 shown in FIG. 11 may be the same as that of the collection container 281 shown in FIG. 10. The configuration of the temperature adjusting mechanism 282 shown in FIG. 11 may be the same as that of the temperature adjusting mechanism 282 shown in FIG. 10. The configuration of the cylinder part 285 shown in FIG. 11 may be the same as that of the cylinder part 285 shown in FIG. 10. The configuration of the filter 288 shown in FIG. 11 may be the same as that of the filter 288 shown in FIG. 10.

The receiving part 283 shown in FIG. 11 may be different from the receiving part 283 shown in FIG. 10 in that the receiving part 283 shown in FIG. 11 may not be constituted by the receiving member 283*a* and the support member 283*b* which are separated from the collection container 281 and the prevention part 284. The receiving part 283 shown in FIG. 11 may be formed integrally with the collection container 281 and the prevention part 284. The receiving part 283 may be formed such that its receiving surface S protrudes inward from part of the inner periphery of the side portion 281*c* of the collection container 281. When the prevention part 284 is formed integrally with the collection container 281 as part of the collection container 281, the receiving part 283 may be formed to protrude inward from part of the inner periphery of the prevention part 284.

When the prevention part 284 shown in FIG. 11 is formed as part of the collection container 281, the tapered surface 284*b* of the prevention part 284 may be formed in the inner periphery of the prevention part 284 where the receiving part 283 is not formed.

The receiving part 283 and the prevention part 284 shown in FIG. 11 may form a pipe line having an inner wall surface formed by at least the receiving surface S of the receiving part 283 and the tapered surface 284*b* of the prevention part 284. This pipe line may allow the communication between the cylinder part 285 and the collection container 281. This pipe line may allow the target 27 having entered the target collector 28 to be reflected from its inner wall surface multiple times, and then to be introduced into the collection container 281.

When the target 27 and the fragmented materials 274 collide against the wall surface multiple times, the kinetic energies of the target 27 and the fragmented materials 274 may be further reduced. Therefore, it is possible to more effectively reduce the amount and the speed of the dispersion of the fragmented materials 274 generated by the collision. In addition, when the target 27 and the fragmented materials 274 collide against the wall surface multiple times, the target 27 and the fragmented materials 274 may be crushed into smaller pieces. When the target 27 and the fragmented materials 274 are crushed into small pieces, the impact force of the collision of the fragmented materials 274 against the liquid surface 273*a* of the collected target 273 may be weakened. Therefore, the collected target 273 may not be broken into splashes, and therefore not likely to jump up as the fragmented materials 274. The other configurations of the receiving part 283 and the prevention part 284 may be the same as those of the receiving part 283 and the prevention part 284 shown in FIG. 10.

With the above-described configuration, the fourth example of the target collector 28 can produce the same effect as the third example of the target collector 28. Moreover, the fourth example of the target collector 28 can introduce the target 27 into the collection container 281 after a number of collisions of the target 27 against the receiving surface S of the receiving part 283 and the tapered surface 284*b* of the prevention part 284 which constitute the inner wall surface of the pipe line. Therefore, the fourth example of the target collector 28 can more effectively prevent the fragmented materials 274 from dispersing to the outside of the target collector 28 than the third example of the target collector 28. Moreover, the fourth example of the target collector 28 is composed of a smaller number of parts and has a simpler structure than the third example of the target collector 28, and therefore can reduce the costs.

6.4 Fifth Example of the Target Collector

Figure 12:
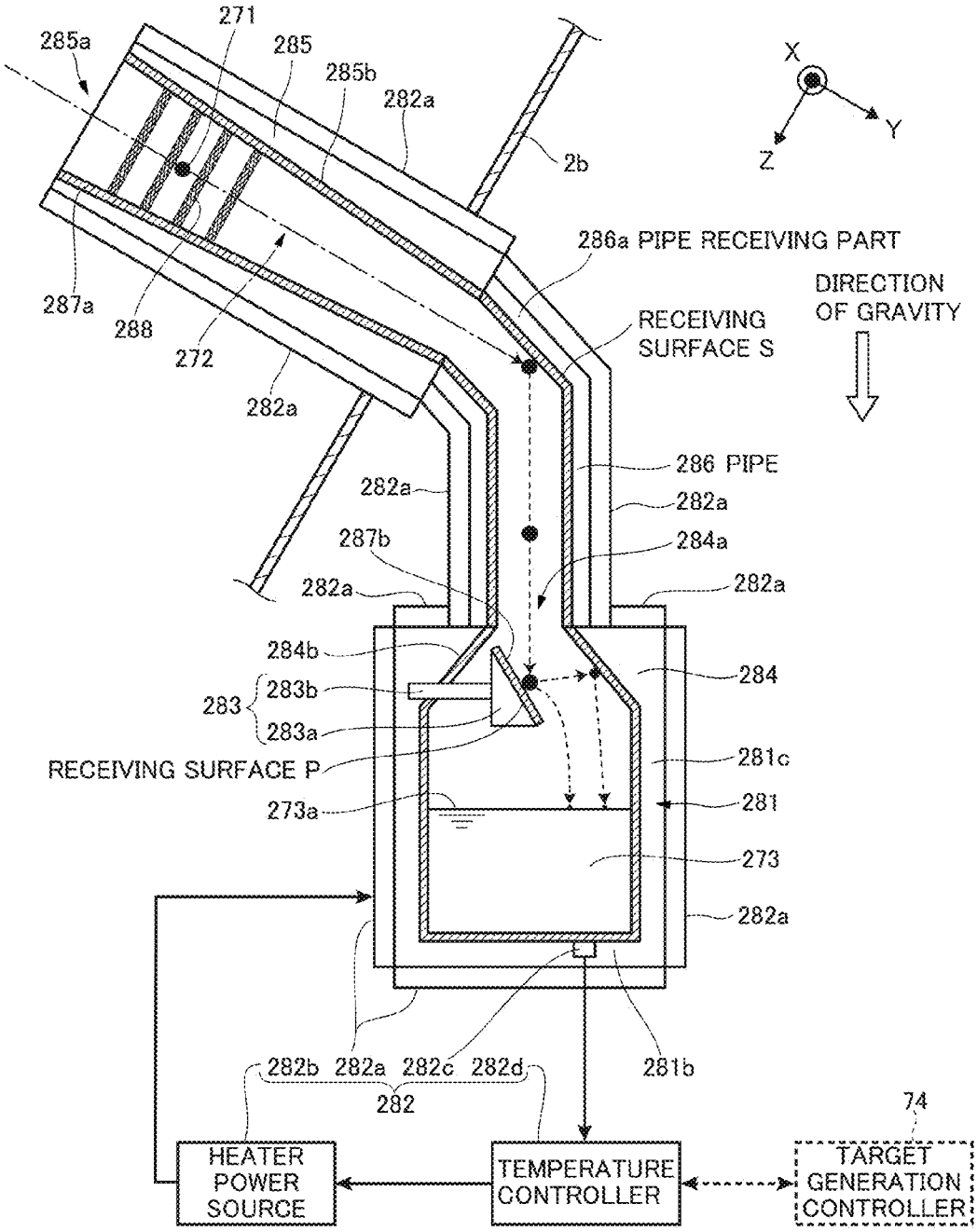
FIG. 12 shows the configuration of a fifth example of the target collector.

Now, with reference to FIG. 12, the configuration of the fifth example of the target collector 28 will be described. FIG. 12 shows the configuration of the fifth example of the target collector. With the EUV light generation apparatus 1 including the fifth example of the target collector 28, a Z direction in which the EUV light 252 is outputted from the chamber 2 of the EUV light generation apparatus 1 to the exposure device 6 may be inclined with respect to the horizontal direction. Therefore, the chamber 2 may be provided such that the direction of its central axis is inclined with respect to the horizontal direction. The target supply part 26 provided on the side surface of the chamber 2 may be provided such that the direction of the central axis of the nozzle 262 is inclined with respect to the direction of gravity. The target traveling path 272 may be inclined with respect to the direction of gravity. As shown in FIG. 12, the fifth example of the target collector 28 may include the collection container 281, the temperature adjusting mechanism 282, the receiving part 283, the prevention part 284, the cylinder part 285, a pipe 286 and the filter 288. The configuration of the fifth example of the target collector 28 shown in FIG. 12, which is the same as that of the third example of the target collector 28 shown in FIG. 10, will not be described again here.

The configuration of the temperature adjusting mechanism 282 shown in FIG. 12 may be the same as that of the temperature adjusting mechanism 282 shown in FIG. 10.

The collection container 281 shown in FIG. 12 may be disposed such that the direction of its central axis is parallel to the direction of gravity. The other configuration of the collection container 281 may be the same as that of the collection container 281 shown in FIG. 10.

The cylinder part 285 shown in FIG. 12 may be disposed such that the direction of its central axis matches the target traveling path 272. The direction of the central axis of the cylinder part 285 may be inclined with respect to the direction of gravity. The cylinder part 285 may be formed to extend from its base end corresponding to the end of the pipe 286, toward the target supply part 26 and the plasma generation region 25. The cylinder part 285 may guide the target 27 having entered the target collector 28 to the opening 284*a* of the prevention part 284 via the pipe 286. The cylinder part 285 may guide the fragmented materials 274 generated by the collision of the target 27 against the tapered surface 285*b* to the opening 284*a* via the pipe 286. The other configuration of the cylinder part 285 may be the same as that of the cylinder part 285 shown in FIG. 10.

The pipe 286 may connect between the collection container 281 and the cylinder part 285. The pipe 286 may be disposed outside the chamber 2. The heater 282*a* of the temperature adjusting mechanism 282 may be fixed to the outer periphery of the pipe 286. The temperature adjusting mechanism 282 may maintain the temperature in the pipe 286 within a predetermined range of temperatures equal to or higher than the melting point of the target 27.

The pipe 286 may be formed to extend from its base end corresponding to the end of the cylinder part 285 opposite to the opening 285*a*, toward the prevention part 284 formed as part of the collection container 281. The pipe 286 extending from its base end corresponding to the end of the cylinder part 285 may be bent on the extension of the target traveling path 272 and extend toward the prevention part 284. The pipe 286 may allow the collection container 281 and the prevention part 284 to communicate with the cylinder part 285. The bent portion of the pipe 286 may be located at the intersection of the extension of the target traveling path 272 and the extension of the central axis of the collection container 281 and the prevention part 284. The bent portion of the pipe 286 may include a pipe receiving part 286*a*.

The pipe receiving part 286*a* may receive the target 27 having entered the target collector 28 via the filter 288. The pipe receiving part 286*a* may receive the target 27 by making the target 27 collide against the receiving surface S. The receiving surface S of the pipe receiving part 286*a* may be disposed to face the target supply part 26 and the plasma generation region 25. The receiving surface S of the pipe receiving part 286*a* may be disposed to face a receiving surface P (described later) of the receiving part 283. The receiving surface S of the pipe receiving part 286*a* may be disposed to face the opening 284*a* of the prevention part 284. The receiving surface S of the pipe receiving part 286*a* may be located on the extension of the target traveling path 272. The receiving surface S may be inclined with respect to the target traveling path 272 with a predetermined inclination angle. The inclination angle of the receiving surface S may be provided to prevent the fragmented materials 274 generated by the collision against the receiving surface S from dispersing to the outside of the target collector 28. The inclination angle of the receiving surface S with respect to the target traveling path 272 may be provided such that the incidence angle θ of the target 27 satisfies $0° < \theta < 90°$. More preferably, the inclination angle of the receiving surface S with respect to the target traveling path 272 may be provided such that the incidence angle θ of the target 27 satisfies $45° < \theta < 90°$. Therefore, when the target 27 having entered the target collector 28 via the filter 288 collides against the receiving surface S of the pipe receiving part 286*a*, the receiving surface S may reflect most of the target 27 toward the receiving surface P of the receiving part 283.

The receiving surface S of the pipe receiving part 286*a* may be coated with the coating material 287*a*. Alternatively, a surface treatment may be applied to the receiving surface S of the pipe receiving part 286*a* to make the contact angle with the target 27 be equal to or smaller than 90 degrees. Likewise, the inner periphery of the pipe 286 except the receiving surface S may be coated with the coating material 287*a*, or subjected to the surface treatment. Therefore, when the target 27 having entered the target collector 28 via the filter 288 collides against the receiving surface S of the pipe receiving part 286*a*, the receiving surface S may be wetted by part of the target 27. Accordingly, the receiving surface S can reduce the amount and the speed of the dispersion of the fragmented materials 274 generated by the collision against the receiving surface S.

The receiving surface 283 shown in FIG. 12 may receive the target 27 or the fragmented materials 274 reflected from the receiving surface S of the pipe receiving part 286*a*. The receiving member 283*a* of the receiving part 283 may receive the target 27 or the fragmented materials 274 reflected from the receiving surface S of the pipe receiving part 286*a* by making the target 27 or the fragmented materials 274 collide against the receiving surface P. The other configuration of the receiving part 283 may be the same as that of the receiving part 283 shown in FIG. 10.

The prevention part 284 shown in FIG. 12 may prevent the fragmented materials 274 generated by the collision against the receiving surface P from dispersing to the outside of the target collector 28. The prevention part 284 may be formed to extend from its base end corresponding to the periphery of the opening 281*a* of the collection container 281, toward the direction opposite to the direction of gravity which matches the direction of the central axis of the collection container 281. The leading end of the prevention part 284 may be connected to the end of the pipe 286. The other configuration of the prevention part 284 may be the same as that of the prevention part 284 shown in FIG. 10.

With the above-described configuration, the fifth example of the target collector 28 can produce the same effect as the third example of the target collector 28. In addition, the fifth example of the target collector 28 can introduce the target 27 having entered the target collector 28 via the filter 28 into the collection container 281 after a plurality of collisions of the target 27 against the receiving surface S and the receiving surface P. Moreover, with the fifth example of the target collector 28, it is possible to lengthen and complicate the route from the collection container 281 to the outside of the target collector 28 by providing the pipe 286 to connect between the collection container 281 and the cylinder part 285. Therefore, the fifth example of the target collector 28 can more effectively prevent the fragmented materials 274 from dispersing to the outside of the target collector 28 than the third example of the target collector 28. Moreover, the fifth example of the target collector 28 can collect the target 27 while preventing the target 27 from dispersing to the outside of the target collector 28, even though the target traveling path 272 is inclined with respect to the direction of gravity, or the target 27 enters the target collector 28 not through the target traveling path 272.

7. Target Collector of the EUV Light Generation Apparatus According to Embodiment 3

With reference to FIGS. 13A to 19C, the target collector 28 of the EUV light generation apparatus 1 according to Embodiment 3 will be described. The configuration of the target collector 28 of the EUV light generation apparatus 1 according to Embodiment 3 may be the same as that of the target collector 28 of the EUV light generation apparatus 1 according to Embodiment 2, except for the filter 288. Hereinafter, the target collector 28 of the EUV light generation apparatus 1 according to Embodiment 3 will be explained as sixth to tenth examples of the target collector 28. The configuration of the target collector 28, which is the same as that of the target collector 28 according to Embodiment 2, that is, the second to fifth examples of the target collector 28 shown in FIGS. 8 to 12, will not be described again here.

7.1 Sixth Example of the Target Collector

Figure 13A:
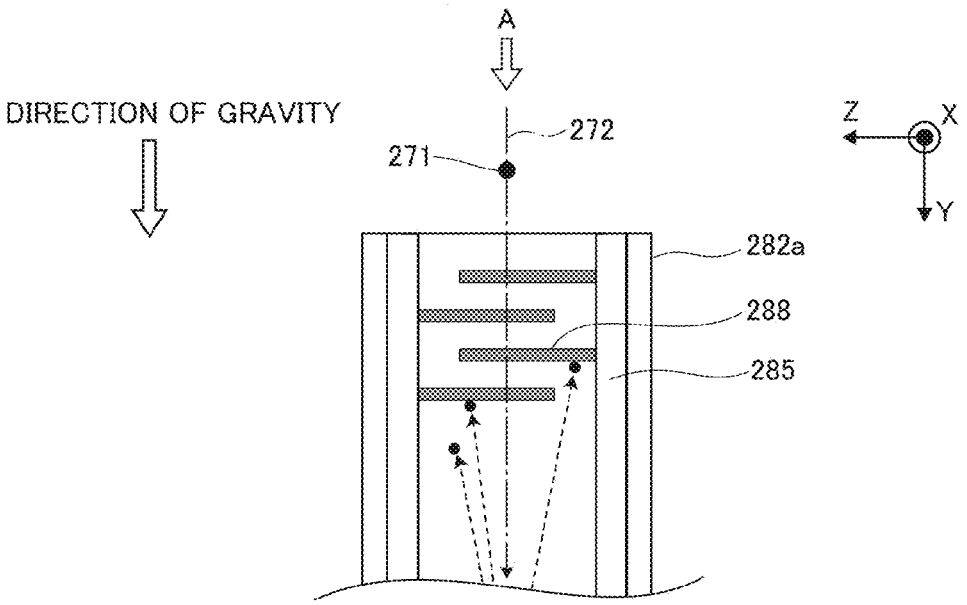
FIG. 13A shows the configuration of the filter of a sixth example of the target collector.
Figure 13B:
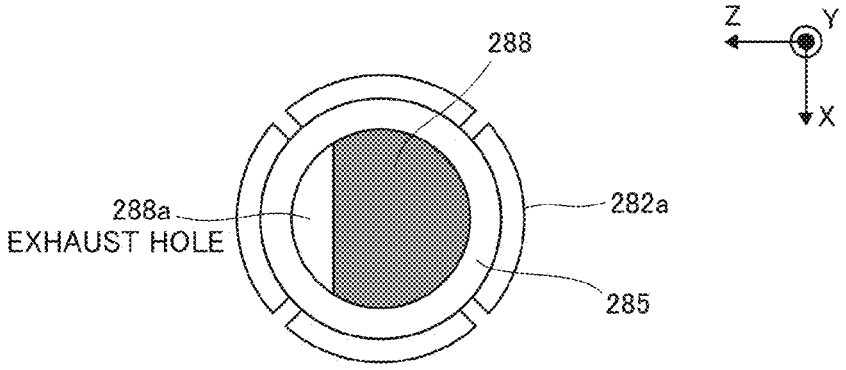
FIG. 13B shows a view of FIG. 13A from direction A, where a via-hole is not provided in advance in the filter.
Figure 13C:
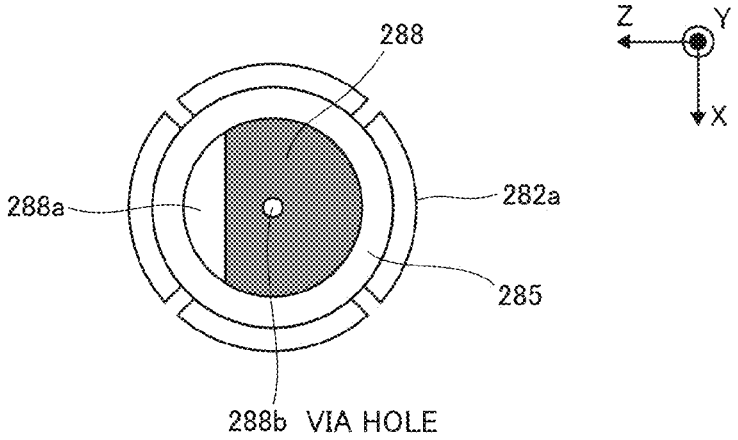
FIG. 13C shows a view of FIG. 13A from the direction A, where the via-hole is provided in advance in the filter.

Now, with reference to FIGS. 13A to 13C, the configuration of the filter 288 of the sixth example of the target collector 28 will be described. FIG. 13A shows the configuration of the filter 288 of the sixth example of the target collector 28. FIG. 13B shows a view of FIG. 13A from direction A, where a via-hole 288*b* is not provided in advance in the filter 288. FIG. 13C shows a view of FIG. 13A from the direction A, where the via-hole 288*b* is provided in advance in the filter 288. Here, the direction A shown in FIG. 13A may be the traveling direction of the target 27 entering the target collector 28 along the target traveling path 272.

The filter 288 of the sixth example of the target collector 28 may be made with metallic foil. The metallic foil may be, for example, aluminium foil. The thickness of the metallic foil may be, for example, about 20 μm to 100 μm. When the target 27 having entered the target collector 28 passes through the filter 288 made with metallic foil, the filter 288 may be penetrated by the target 27. After the target 27 has collided against and penetrated the filter 288, its kinetic energy may be reduced.

As shown in FIG. 13B, an exhaust hole 288*a* may be formed in the filter 288 made with metallic foil. The exhaust hole 288*a* may be a through-hole that allows the gas in the collection container 281 to flow out into the chamber 2 when the gas in the chamber 2 is discharged. By this means, when the gas in the chamber 2 is discharged, it is possible to flow the gas in the collection container 281 out into the chamber 2 via the exhaust hole 288*a*, without problem such as deformation of the filter 288 caused by pressure fluctuation. Then, the gas flowing out of the collection container 281 into the chamber 2 may be discharged. In this case, the fragmented materials 274 may be caught by the filter 288.

As shown in FIG. 13A, a plurality of filters 288 made with metallic foil may be provided in the cylinder part 285. The plurality of filters 288 may include the exhaust holes 288*a*, respectively. The exhaust hole 288*a* formed in each of the plurality of filters 288 may be positioned in the periphery of the filter 288 not to intersect with the extension of the target traveling path 272. The positions of the exhaust holes 288*a* of the plurality of filters 288 may be different from each other when viewed from the traveling direction of the target 27. As shown in FIG. 13A, the positions of the exhaust holes 288*a* of the adjacent filters 288 may be different from each other, when viewed from the traveling direction of the target 27. By this means, it is possible to lengthen and complicate the route from the collection container 281 to the outside of the target collector 28. In addition, the filter 288 can easily catch the fragmented materials 274. Moreover, the fragmented materials 274 cannot be easy to disperse to the outside of the target collector 28.

As shown in FIG. 13C, the via-hole 288*b* may be formed in advance in the filter 288 made with metallic foil. The via-hole 288*b* may be a through-hole which is formed in advance at the position at which the target 27 having entered the target collector 28 penetrates the filter 288. By this means, the target 27 having entered the target collector 28 may not collide against but pass through the filter 288. Therefore, there may be little possibility of generating the fragmented materials 274 caused by the collision of the target 27 against the filter 288.

The plurality of filters 288 may include the via-holes 288*b*, respectively. The via-holes 288*b* formed in the plurality of filters 288 respectively may be positioned to intersect with the extension of the target traveling path 272.

Here, as shown in FIG. 13B, the via-hole 288*b* may not necessarily be formed in each of the plurality of filters 288. Even in this case, since the target 27 may pass completely through the filter 288 as described above, it is possible to significantly reduce the amount of the fragmented materials 274 generated by the collision of the target 27 against the filter 288. Moreover, in this case, a process for alignment to place the through-hole 288*b* on the extension of the target traveling path 272 is not needed. Therefore, it is possible to prevent an increase in the number of processes. The other configuration of the filter 288 may be the same as that of the filter 288 shown in FIGS. 8 to 12.

7.2 Seventh Example of the Target Collector

Figure 14A:
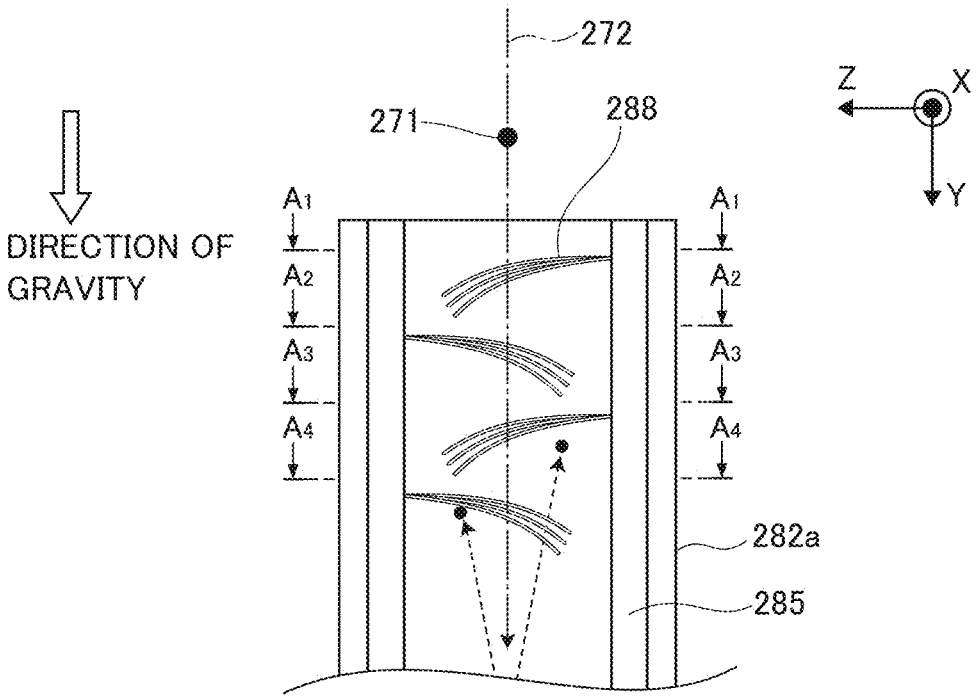
FIG. 14A shows the configuration of the filter of a seventh example of the target collector.
Figure 14B:
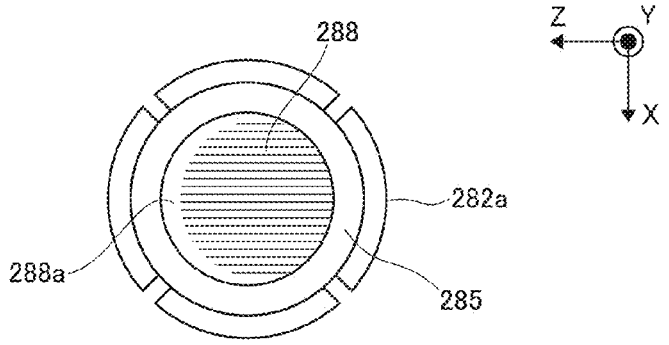
FIG. 14B shows a view of FIG. 14A from direction $A_1$.
Figure 14C:
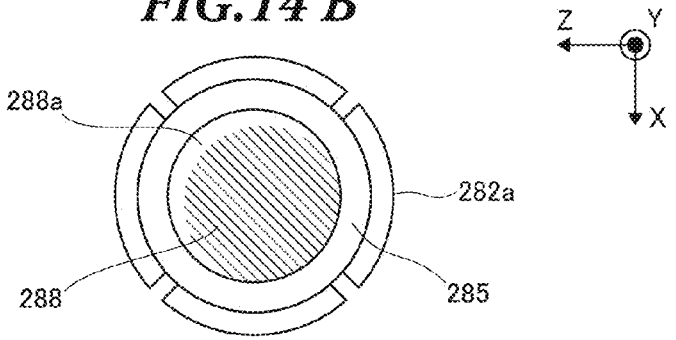
FIG. 14C shows a view of FIG. 14A from direction $A_2$.
Figure 14D:
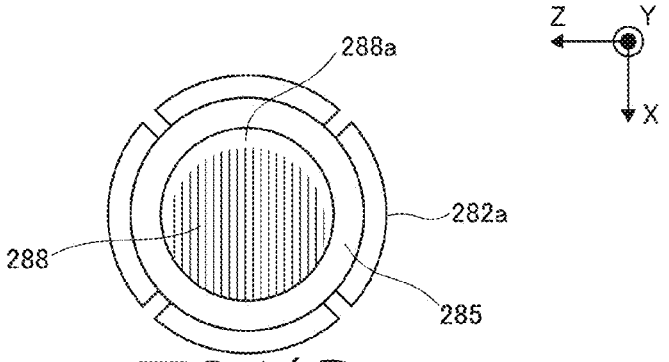
FIG. 14D shows a view of FIG. 14A from direction $A_3$.
Figure 14E:
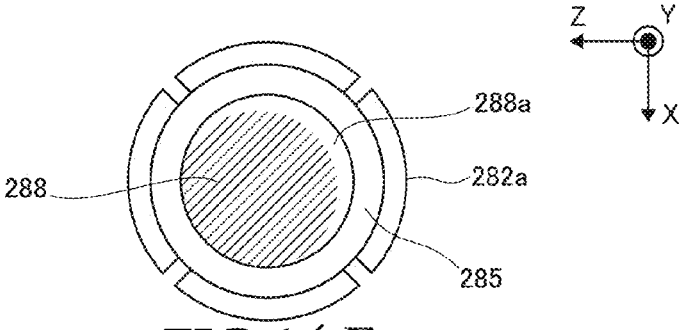
FIG. 14E shows a view of FIG. 14A from direction $A_4$.

Now, with reference to FIGS. 14A to 14E, the configuration of the filter 288 of the seventh example of the target collector 28 will be described. FIG. 14A shows the configuration of the filter 288 of the seventh example of the target collector 28. FIG. 14B shows a view of FIG. 14A from direction $A_1$. FIG. 14C shows a view of FIG. 14A from direction $A_2$. FIG. 14D shows a view of FIG. 14A from direction $A_3$. FIG. 14E shows a view of FIG. 14A from direction $A_4$. Here, the directions $A_1$ to $A_4$ shown in FIG. 14A may be the traveling direction of the target 27 entering the target collector 28 along the target traveling path 272.

The filter 288 of the seventh example of the target collector 28 may be formed by a fiber member. When the target 27 collides against the filter 288 formed by the fiber member, the filter 288 is not penetrated by the target 27. One fiber member forming one filter 288 may be constituted by a plurality of elastic fiber bundles. One fiber bundle may be a bundle of one or more fibers. The fiber bundle may be, for example, made with carbon fibers. The diameter of one fiber bundle may be smaller than the diameter of the target 27 having the shape of the droplet 271. The diameter of one fiber bundle may be, for example, about 10 μm. The distance between the adjacent fiber bundles of one fiber member may be sufficiently greater than the diameter of the target 27, when viewed from the traveling direction of the target 27. The distance between the adjacent fiber bundles may be, for example, about 100 μm. The state in which the target 27 having entered the target collector 28 passes through the filter 288 will be described later with reference to FIGS. 15A to 15C.

As shown in FIGS. 14A to 14E, the plurality of fiber bundles constituting one fiber member may be formed to extend side by side in the same direction from their base ends corresponding to part of the inner periphery of the cylinder part 285, when viewed from the traveling direction of the target 27. The direction in which each of the plurality of fiber bundles extends may be the radial inward direction of the cylinder part 285 intersecting with the extension of the target traveling path 272. The leading end of each of the plurality of fiber bundles may not be fixed to the inner periphery of the cylinder part 285. That is, each of the plurality of fiber bundles may be fixed to the inner periphery of the cylinder part 285 with a cantilever structure having a fixed end as the base end and a free end as the leading end. As shown in FIG. 14A, the leading end of each of the plurality of fiber bundles may be deflected in the direction of gravity.

In other words, one end of the fiber member constituting the filter 288 may be fixed to the inner periphery of the cylinder part 285 as a fixed end, while the other end may not be fixed to the inner periphery of the cylinder part 285 as a free end. The free end of the fiber member may be deflected in the direction of gravity. Here, space may be created between the free end of the filter 288 deflected in the direction of gravity and the inner periphery of the cylinder part 285. The space may function as the above-described exhaust hole 288*a* as shown in FIGS. 14B to 14E. That is, the filter 288 may include the exhaust hole 288*a*.

As shown in FIG. 14A, a plurality of filters 288 formed by the fiber members may be provided in the cylinder part 285. The plurality of filters 288 may include the exhaust holes 288*a*, respectively. The exhaust hole 288*a* of each of the plurality of filters 288 may be positioned in the periphery of the filter 288 not to intersect with the extension of the target traveling path 272. The positions of the exhaust holes 288*a* of the plurality of filters 288 may be different from each other, when viewed from the traveling direction of the target 27. As shown in FIGS. 14B to 14E, the positions of the exhaust holes 288*a* may be shifted in the circumferential direction of the cylinder part 285 in sequence, according to the traveling direction of the target 27 having entered the target collector 28 along the target traveling path 272. When the positions of the exhaust holes 288*a* are shifted in sequence as described above, the positions of the exhaust holes 288*a* of the adjacent filters 288 may be different from each other, when viewed from the traveling direction of the target 27. Moreover, it is possible to lengthen and complicate the route from the collection container 281 to the outside of the target collector 28. By this means, the filter 288 can easily catch the fragmented materials 274. In addition, the fragmented materials 274 cannot be easy to disperse to the outside of the target collector 28.

Figure 15A:
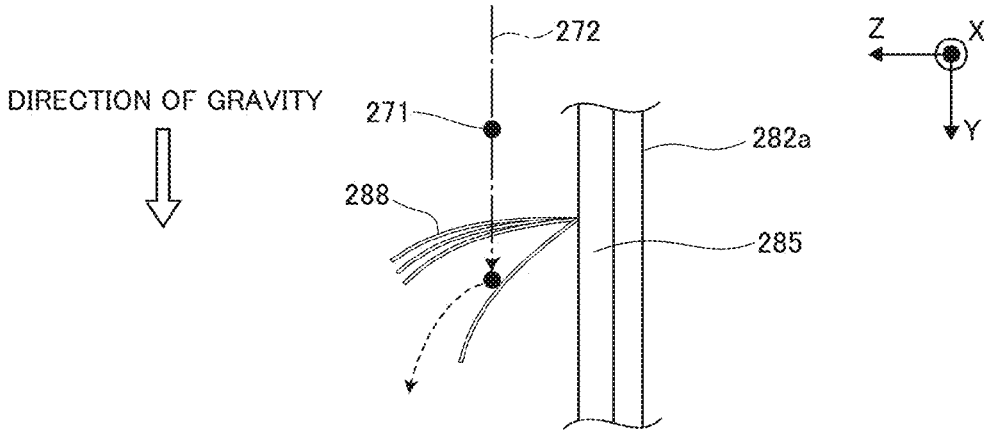
FIG. 15A is a drawing explaining a state where a target collides against and passes through the filter shown in FIG. 14A.
Figure 15B:
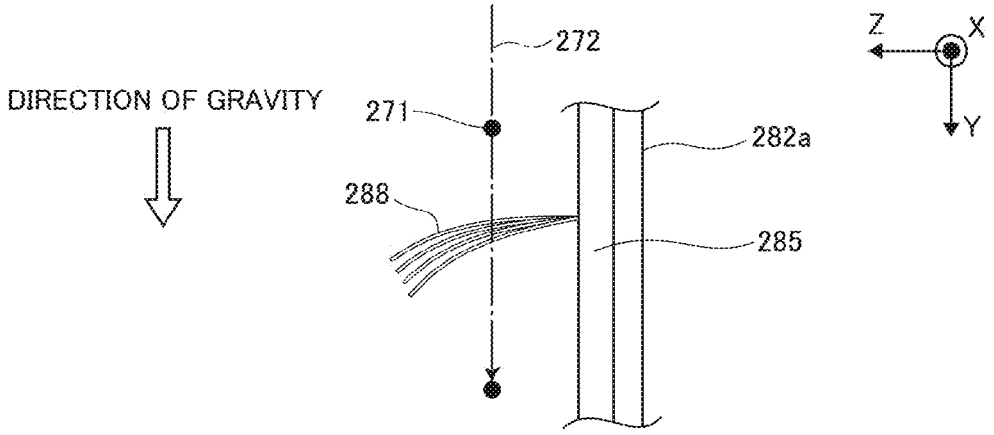
FIG. 15B is a drawing explaining a state where the target passes through the filter shown in FIG. 14A without colliding against the filter.
Figure 15C:
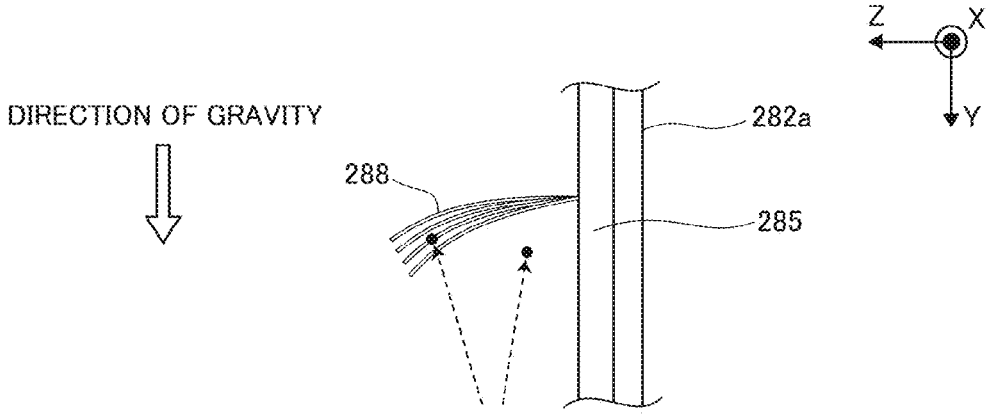
FIG. 15C is a drawing explaining a state of the fragmented materials after the target passes through the filter shown in FIG. 14A.

Now, with reference to FIGS. 15A to 15C, the situation where the target 27 having entered the target collector 28 passes through the filter 288 formed by the fiber member will be described. FIG. 15A is a drawing explaining a state where the target 27 collides against and passes through the filter 288 shown in FIG. 14A. FIG. 15B is a drawing explaining a state where the target 27 passes through the filter 288 shown in FIG. 14A without colliding against the filter 288. FIG. 15C is a drawing explaining a state of the fragmented materials 274 after the target 27 passes through the filter 288 shown in FIG. 14A.

As described above, the free end of the filter 288 formed by the fiber member, which is not fixed to the inner periphery of the cylinder part 285, may be deflected. In addition, when viewed from the traveling direction of the target 27, the distance between the adjacent fiber bundles may be sufficiently greater than the diameter of the target 27.

Therefore, as shown in FIG. 15A, when the target 27 collides against the filter 288 formed by the fiber member, the filter 288 may not be penetrated by the target 27 but be deflected toward the collection container 281 in the traveling direction of the target 27. The filter 288 deflected toward the collection container 281 may not repel the target 27 colliding against the filter 288 but guide the target 27 to the collection container 281. Therefore, the target 27 colliding against the filter 288 can pass through the filter 288 without being crushed by the filter 288 and generating the fragmented materials 274, or staying in the filter 288. In this case, the kinetic energy of the target 27 may be reduced due to the deflection of the filter 288 formed by the fiber member. Therefore, when a plurality of filters 288 are provided, it is possible to improve the effect of reducing the kinetic energy of the target 27.

After that, as described with reference to FIGS. 9A to 9C, the target 27 having passed through the filter 288 may collide against, for example, the receiving surface S shown in FIG. 8, and therefore be crushed, and a small percentage of the crushed target 27 may disperse to the cylinder part 285 as the fragmented materials 274. However, as shown in FIG. 15C, the fragmented materials 274 dispersing to the cylinder part 285 may be caught by the filter 288. When a plurality of filters 288 are provided, it is possible to improve the effect of catching the fragmented materials 274.

Here, as shown in FIG. 15B, the target 27 having entered the target collector 28 may not collide against but pass through the filter 288. The kinetic energy of this target 27 having passed through the filter 288 without colliding against the filter 288 may not be reduced. Even in this case, most of the fragmented materials 274 may be reflected from, for example, the prevention part 284 shown in FIG. 8 and collected in the collection container 281. A small percentage of the fragmented materials 274 dispersing to the cylinder part 285 may be caught by the filter 288. The other configuration of the filter 288 may be the same as that of the filter 288 shown in FIGS. 8 to 12.

7.3 Eighth Example of the Target Collector

Figure 16A:
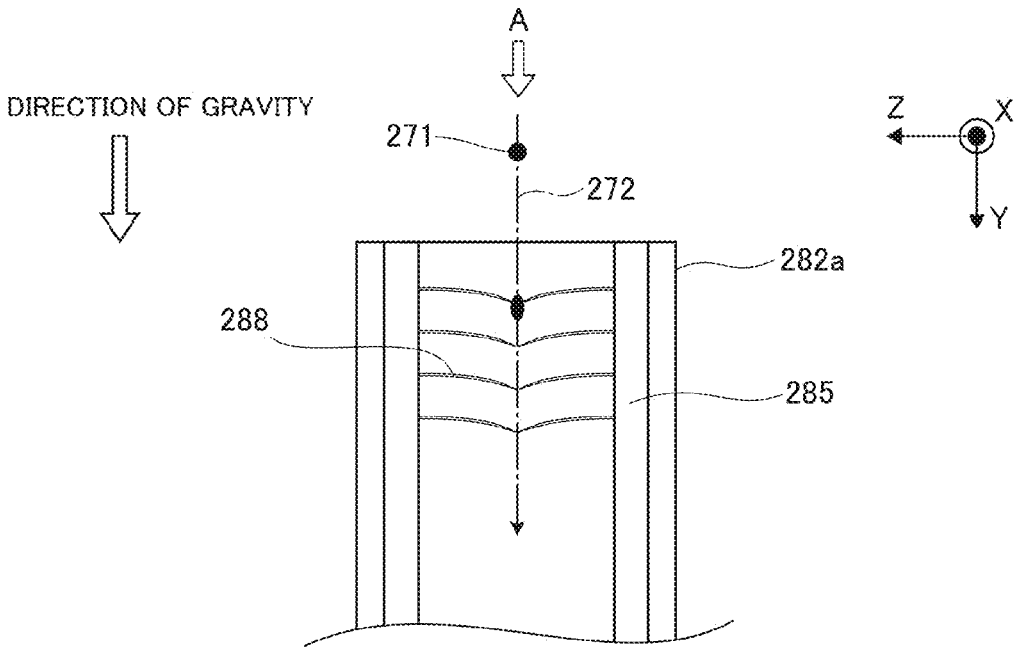
FIG. 16A shows the configuration of the filter of an eighth example of the target collector.
Figure 16B:
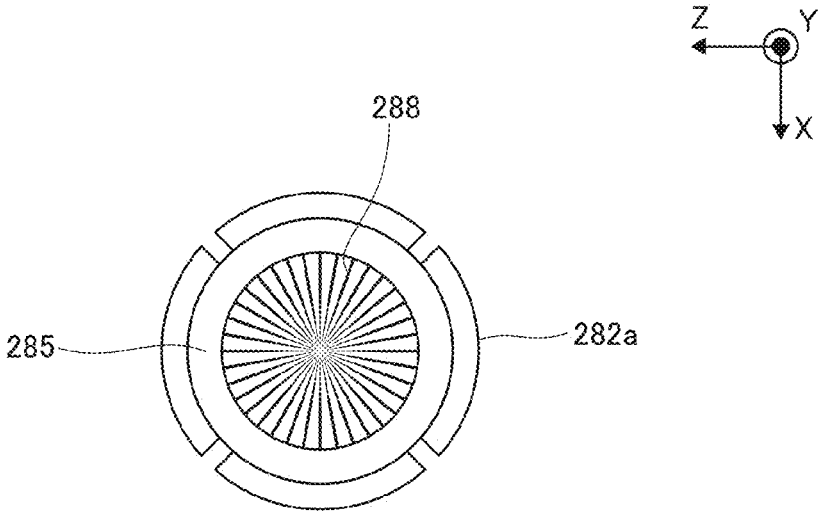
FIG. 16B shows a view of FIG. 16A from direction A.

Now, with reference to FIGS. 16A to 16B, the configuration of the filter 288 of the eighth example of the target collector 28 will be described. FIG. 16A shows the configuration of the filter 288 of the eighth example of the target collector 28. FIG. 16B shows a view of FIG. 16A from direction A. Here, the direction A shown in FIG. 16A may be the traveling direction of the target 27 entering the target collector 28 along the target traveling path 272.

The filter 288 of the eighth example of the target collector 28 may be formed by a fiber member in the same way as the filter 288 shown in FIGS. 14A to 14E. Here, when viewed from the traveling direction of the target 27, a plurality of fiber bundles constituting the fiber member may be formed to extend from their base ends corresponding to the entire inner periphery of the cylinder part 285, toward the center of the inside diameter of the cylinder part 285 as shown in FIG. 16B.

The plurality of fiber bundles constituting the fiber member may be fixed to the inner periphery of the cylinder part 285 with the cantilever structure. The base end of each of the plurality of fiber bundles may be fixed to the inner periphery of the cylinder part 285 as a fixed end. Meanwhile, the leading end of each of the plurality of fiber bundles may not be fixed to the inner periphery of the cylinder part 285 as a free end. Each of the free ends of the fiber bundles may be deflected in the direction of gravity.

As shown in FIG. 16B, the base ends of the plurality of fiber bundles may be fixed to the entire inner periphery of the cylinder part 285 at intervals. By this means, when the gas in the chamber 2 is discharged, the gas in the collection container 281 may flow out into the chamber 2 via the space between the plurality of fiber bundles. Then, the gas flowing out of the collection container 281 into the chamber 2 may be discharged. In this case, the fragmented materials 274 may be caught by the fiber member constituted by the plurality of fiber bundles. In addition, as shown in FIGS. 16A and 16B, the leading ends of the plurality of fiber bundles may contact each other at the center of the inside diameter of the cylinder part 285, and may be deflected in the direction of gravity. By this means, the target 27 having entered the target collector 28 collides against the filter 288, and therefore can have its kinetic energy reduced and pass through the filter 288.

Moreover, as shown in FIG. 16A, a plurality of filters 288 may be provided in the cylinder part 285. The positions at which the distances between the plurality of fiber bundles are provided may be different for each of the plurality of filters 288, when viewed from the traveling direction of the target 27. The positions at which the distances between the fiber bundles of each of the plurality of filters 288 are provided may be different from the positions at which the distances between the fiber bundles of adjacent one of the filters 288 are provided, when viewed from the traveling direction of the target 27. By this means, it is possible to lengthen and complicate the route from the collection container 281 to the outside of the target collector 28. The other configuration of the filter 288 may be the same as that of the filter 288 shown in FIG. 14A to 14E.

7.4 Ninth Example of the Target Collector

Figure 17A:
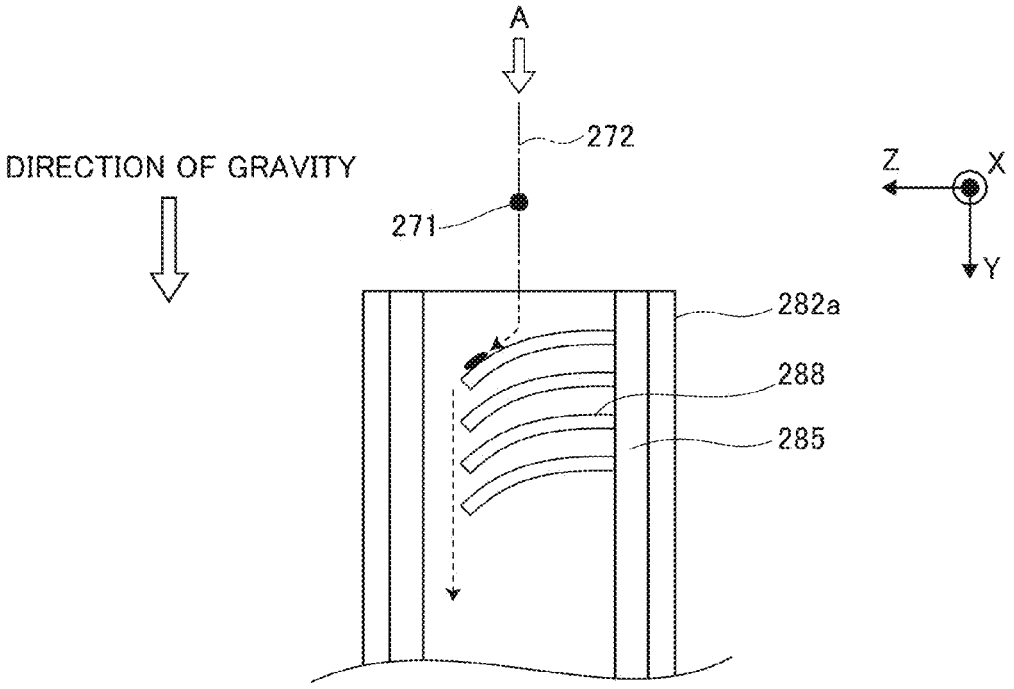
FIG. 17A shows the configuration of the filter of a ninth example of the target collector.
Figure 17B:
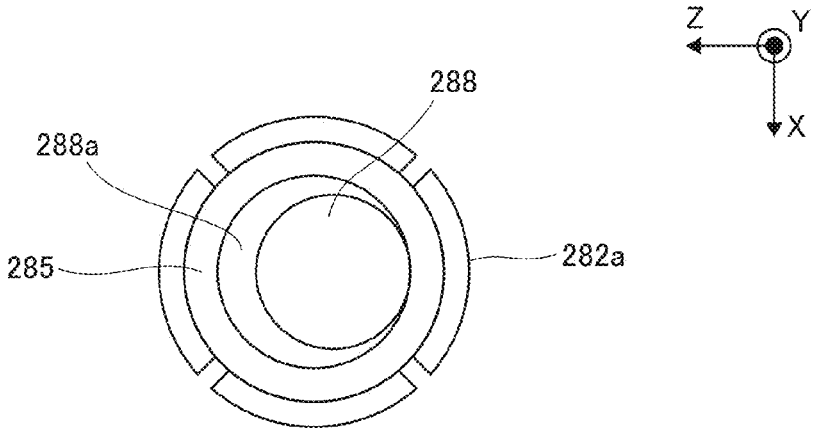
FIG. 17B shows a view of FIG. 17A from direction A.

Now, with reference to FIGS. 17A and 17B, the configuration of the filter 288 of the ninth example of the target collector 28 will be described. FIG. 17A shows the configuration of the filter 288 of the ninth example of the target collector 28. FIG. 17B shows a view of FIG. 17A from direction A. Here, the direction A shown in FIG. 17A may be the traveling direction of the target 27 entering the target collector 28 along the target traveling path 272.

The filter 288 of the ninth example of the target collector 28 may be formed by a curtain member. When the target 27 collides against the filter 288 formed by the curtain member, the filter 288 is not penetrated by the target 27. The curtain member may be an elastic sheet. The curtain member forming the filter 288 may be fixed to the inner periphery of the cylinder part 285 with the cantilever structure. One end of the curtain member forming the filter 288 may be fixed to the inner periphery of the cylinder part 285 as a fixed end, while the other end may not be fixed to the inner periphery of the cylinder part 285 as a free end. As shown in FIG. 17A, the free end of the curtain member may be deflected in the direction of gravity. By this means, the target 27 having entered the target collector 28 may collide against the filter 288, and therefore have its kinetic energy reduced and pass through the filter 288. Here, space may be created between the free end of the filter 288 deflected in the direction of gravity and the inner periphery of the cylinder part 285. The space may function as the above-described exhaust hole 288*a* as shown in FIG. 17B. That is, the filter 288 may include the exhaust hole 288*a*.

As shown in FIG. 17A, a plurality of filters 288 formed by the curtain members may be provided in the cylinder part 285. The plurality of filters 288 may include the exhaust holes 288*a*, respectively. The exhaust hole 288*a* of each of the plurality of filters 288 may be positioned in the periphery of the filter 288 not to intersect with the extension of the target traveling path 272. The exhaust holes 288*a* of the adjacent filters 288 may be provided at the same position, when viewed from the traveling direction of the target 27. Here, the curtain members of the plurality of filters 288 may be formed such that the sizes of the exhaust holes 288*a* are increased in sequence, according to the traveling direction of the target 27.

The curtain member forming the filter 288 may be formed as a sheet, and therefore have a higher elasticity than, for example, the fiber member forming the filter 288 shown in FIG. 14A. The amount of the deflection of the filter 288 formed by the curtain member when the target 27 collides against the filter 288 may be smaller than that of the filter 288 formed by the fiber member. If the amount of the deflection when the target 27 collides against the filter 288 is small, the target 27 may not be easy to fall to the collection container 281. Therefore, the filter 288 formed by the curtain member may have a feature that the target 27 colliding against the filter 288 is not easier to fall to the collection container 281 than the filter 288 formed by the fiber member. In particular, when a plurality of filters 288 are provided, this feature may appear prominently in the filter 288 located in the downstream of the traveling direction of the target 27.

Therefore, as described above, the positions of the exhaust holes 288*a* of the adjacent filters 288 are the same as each other, when viewed from the traveling direction of the target 27. By this means, the target 27 colliding against the filter 288 can be easy to fall to the collection container 281. The other configuration of the filter 288 may be the same as that of the filter 288 shown in FIGS. 14A to 14E.

7.5 Tenth Example of the Target Collector

Figure 18A:
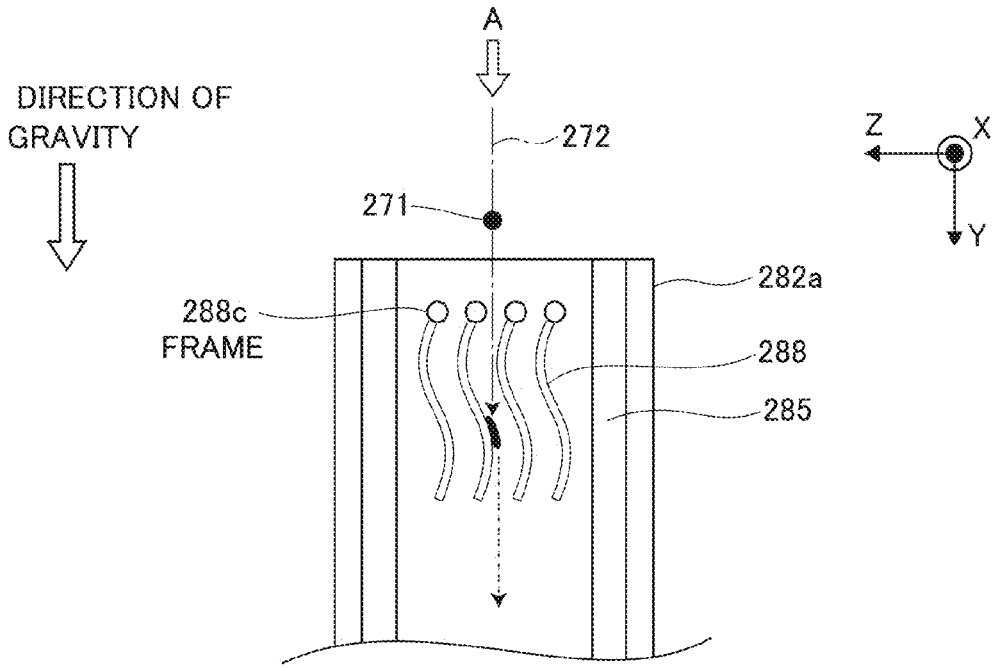
FIG. 18A shows the configuration of the filter of a tenth example of the target collector.
Figure 18B:
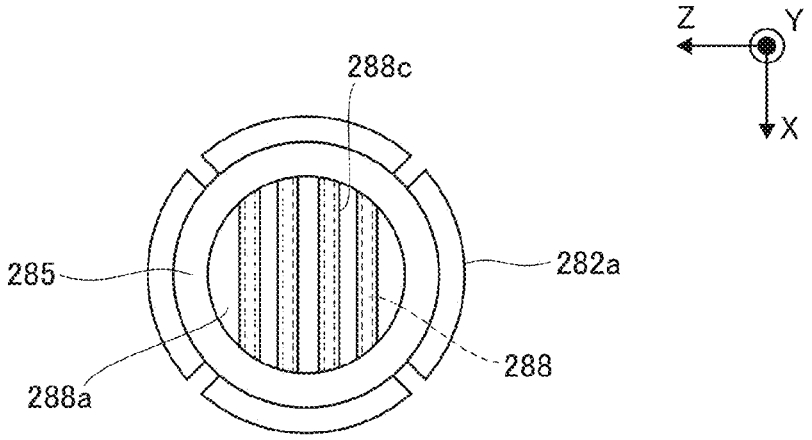
FIG. 18B shows a view of FIG. 18A from direction A.

Now, with reference to FIGS. 18A and 18B, the configuration of the filter 288 of the tenth example of the target collector 28 will be described. FIG. 18A shows the configuration of the filter 288 of the tenth example of the target collector 28. FIG. 18B shows a view of FIG. 18A from direction A. Here, the direction A shown in FIG. 18A may be the traveling direction of the target 27 entering the target collector 28 along the target traveling path 272.

The filter 288 of the tenth example of the target collector 28 may be formed by a curtain member in the same way as the filter 288 shown in FIGS. 17A and 17B. Here, this curtain member forming the filter 288 may be fixed to the inner periphery of the cylinder part 285 via a frame 288*c*. In addition, the curtain member forming the filter 288 of the tenth example of the target collector 28 may have a lower rigidity than the curtain member forming the filter 288 shown in FIGS. 17A and 17B.

The frame 288*c* may be formed in a rod shape. One end of the sheet-like curtain member may be attached to the rod frame 288*c* along the longitudinal direction of the rod frame 288*c*. The frame 288*c* with the curtain member may be fixed to the inner periphery of the cylinder part 285 such that the longitudinal direction of the frame 288*c* is perpendicular to the target traveling path 272. The frame 288*c* with the curtain member may be fixed to the inner periphery of the cylinder part 285 not to intersect with the extension of the target traveling path 272. One end of the curtain member attached to the frame 288*c* may be a fixed end. The other end of the curtain member may be a free end.

The curtain member fixed to the cylinder part 285 via the frame 288*c* may hang down in the direction of gravity as shown in FIG. 18A. The curtain member has a low rigidity, and therefore its surface is curved when the curtain member hangs down. The hanging curtain member with the curved surface may intersect with the extension of the target traveling path 272 at the curved surface. By this means, the target 27 having entered the target collector 28 collides against the filter 288, and therefore can have its kinetic energy reduced and pass through the filter 288.

As shown in FIG. 18A, a plurality of filters 288 may be provided in the cylinder part 285. The frames 288*c* of the plurality of filters 288 may be fixed to the inner periphery of the cylinder part 285 at intervals. By this means, when the gas in the chamber 2 is discharged, the gas in the collection container 281 may flow out into the chamber 2 via the space between the plurality of frames 288*c*. Then, the gas flowing out of the collection container 281 into the chamber 2 may be discharged. In this case, the fragmented materials 274 may be caught by the hanging curtain member with the curved surface. The other configuration of the filter 288 may be the same as that of the filter 288 shown in FIGS. 17A and 17B.

8. Other Examples of Filter Installation

Figure 19A:
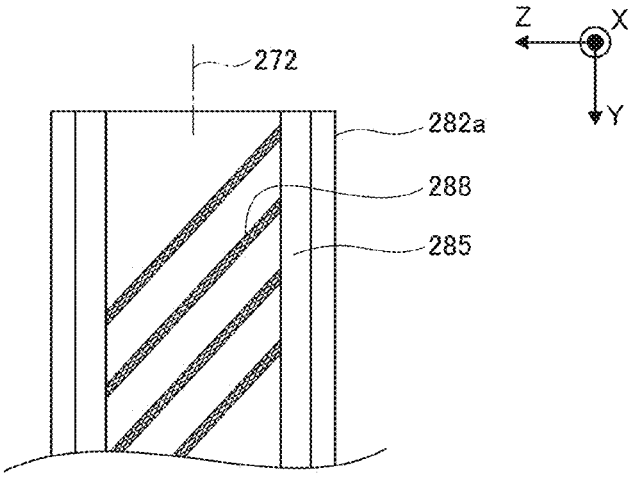
FIG. 19A shows another example 1 of the filter installation.
Figure 19B:
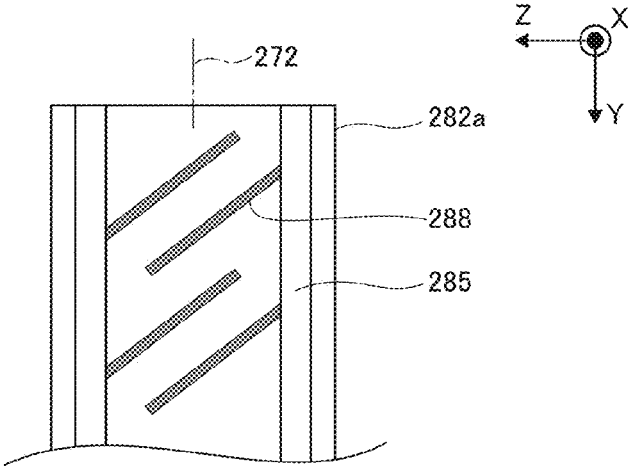
FIG. 19B shows another example 2 of the filter installation.
Figure 19C:
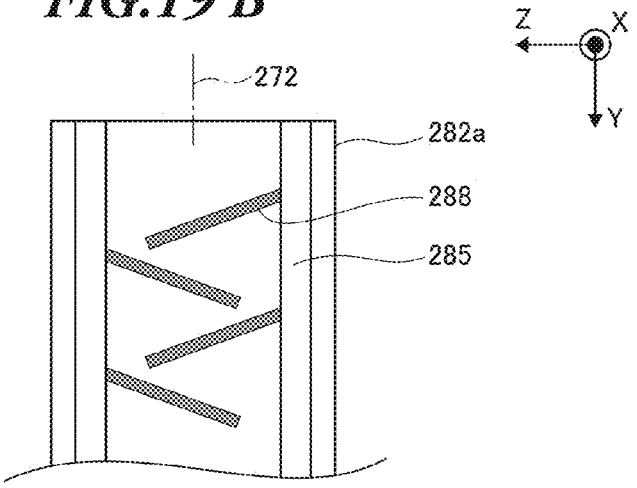
FIG. 19C shows another example 3 of the filter installation.

Now, with reference to FIGS. 19A to 19C, other examples of the installation of the filter 288 will be described. FIG. 19A shows another example 1 of the filter installation. FIG. 19B shows another example 2 of the filter installation. FIG. 19C shows another example 3 of the filter installation.

The filter 288 shown in FIGS. 8 to 12 made with a porous metallic plate or wire netting may be provided to incline to the target traveling path 272 as shown in FIG. 19A. The inclination angle of the filter 288 with respect to the target traveling path 272 may be, for example, 45 degrees.

Among the targets 27 entering the target collector 28, there may be the target 27 having a lower kinetic energy than usual. In particular, at the time of the start or the stop of the generation of the target 27, the target 27 having a lower kinetic energy than usual may enter the target collector 28. When the target 27 having a lower kinetic energy collides against the filter 288 made with, for example, a porous metallic plate, this target 27 may not penetrate the filter 288. The target 27 that could not penetrate the filter 288 may be reflected from the surface of the filter 288, or crushed on the surface of the filter 288 and therefore generate the fragmented materials 274. The target 27 and the fragmented materials 274 may disperse to the outside of the target collector 28.

When the filter 288 is provided to incline to the target traveling path 272, the target 27 that could not penetrate the filter 288 may be reflected from the surface of the filter 288 toward the collection container 281. Therefore, it is possible to prevent the target 27 that could not penetrate the filter 288 or the fragmented materials 274 from dispersing to the outside of the target collector 28.

Also the filter 288 made with metallic foil shown in FIGS. 13A to 13C may be provided to incline to the extension of the target traveling path 272 as shown in FIG. 19B, in the same way as the filter 288 made with a porous metallic plate or wire netting. The inclination angle of the filter 288 with respect to the target traveling path 272 may be, for example, 45 degrees. By this means, the target 27 that could not penetrate the filter 288 is reflected from the surface of the filter 288 toward the collection container 281, and therefore it is possible to prevent the target 27 or the fragmented materials 274 from dispersing to the outside of the target collector 28.

Here, when a plurality of filters 288 are provided to incline to the extension of the target traveling path 272, the inclination directions of the filters 288 may be different from each other. For example, as shown in FIG. 19C, the inclination directions of the adjacent filters 288 may be different from each another. Although FIG. 19C shows the installation state of the plurality of filters 288 made with metallic foil, the same installation state may be applied to the plurality of filters 288 made with porous metallic plates or wire netting. Moreover, the installation states shown in FIGS. 19A to 19C may be applied to the filter 288 formed by the fiber member shown in FIG. 14A to 16B, and the filter 288 formed by the curtain member shown in FIG. 17A to 18B.

9. Others 9.1 Hardware Environment of Each Controller

A person skilled in the art would understand that the subject matters disclosed herein can be implemented by combining a general purpose computer or a programmable controller with a program module or a software application.

In general, the program module includes routines, programs, components and data structures which can execute the processes disclosed herein.

Figure 20:
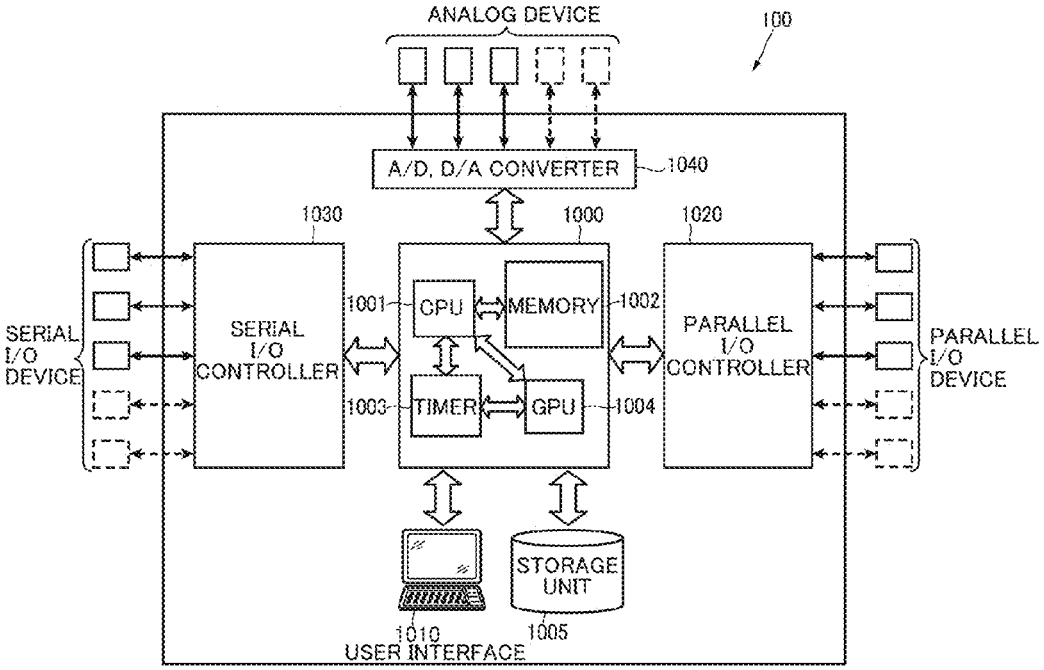
FIG. 20 is a block diagram showing the hardware environment of each of the controllers.

FIG. 20 is a block diagram showing an exemplary hardware environment in which various aspects of the subject matters disclosed herein can be implemented. An exemplary hardware environment 100 shown in FIG. 20 may include a processing unit 1000, a storage unit 1005, a user interface 1010, a parallel I/O controller 1020, a serial I/O controller 1030, and an A/D, D/A converter 1040, but the configuration of the hardware environment 100 is not limited to this.

The processing unit 1000 may include a central processing unit (CPU) 1001, a memory 1002, a timer 1003, and a graphics processing unit (GPU) 1004. The memory 1002 may include a random access memory (RAM) and a read only memory (ROM). The CPU 1001 may be any of commercially available processors. A dual microprocessor or another multiprocessor architecture may be used as the CPU 1001.

The components shown in FIG. 20 may be interconnected with each other to perform the processes described herein.

During its operation, the processing unit 1000 may read and execute the program stored in the storage unit 1005, read data together with the program from the storage unit 1005, and write the data to the storage unit 1005. The CPU 1001 may execute the program read from the storage unit 1005. The memory 1002 may be a work area in which the program executed by the CPU 1001 and the data used in the operation of the CPU 1001 are temporarily stored. The timer 1003 may measure a time interval and output the result of the measurement to the CPU 1001 according to the execution of the program. The GPU 1004 may process image data according to the program read from the storage unit 1005, and output the result of the process to the CPU 1001.

The parallel I/O controller 1020 may be connected to parallel I/O devices that can communicate with the processing unit 1000, such as the EUV light generation controller 5, the target generation controller 74, and the temperature controller 282*d*. The parallel I/O controller 1020 may control the communication between the processing unit 1000 and those parallel I/O devices. The serial I/O controller 1030 may be connected to serial I/O devices that can communicate with the processing unit 1000, such as the heater power source 712, the heater power source 282*b*, the piezoelectric power source 732, and the pressure regulator 721. The serial I/O controller 1030 may control the communication between the processing unit 1000 and those serial I/O devices. The A/D, D/A converter 1040 may be connected to analog devices such as the temperature sensor, the pressure sensor, various sensors for a vacuum gauge, the target sensor 4, and the temperature sensor 282*c* via analog ports, may control the communication between the processing unit 1000 and those analog devices, and may perform A/D, D/A conversion of the contents of the communication.

The user interface 1010 may present the progress of the program executed by the processing unit 1000 to an operator, in order to allow the operator to command the processing unit 1000 to stop the program and to execute an interruption routine.

The exemplary hardware environment 100 may be applicable to the EUV light generation controller 5, the target generation controller 74, and the temperature controller 282*d* in the present disclosure. A person skilled in the art would understand that those controllers may be realized in a distributed computing environment, that is, an environment in which tasks are performed by the processing units connected to each other via a communication network. In this disclosure, the EUV light generation controller 5, the target generation controller 74, and the temperature controller 282*d* may be connected to each other via a communication network such as Ethernet or Internet. In the distributed computing environment, the program module may be stored in both of a local memory storage device and a remote memory storage device.

9.2 Modification

The coating material 287*a* may be a material that has a contact angle of equal to or smaller than 90 degrees with the target 27, and that absorbs the impact of the collision against the target 27. Alternatively, the coating material 287*a* may be replaced with a member formed by laminating a material having a contact angle of equal to or smaller than 90 degrees with the target 27 on the material absorbing the impact of the collision against the target 27. Otherwise, the coating material 287*a* may be a material that has a contact angle of equal to or smaller than 90 degrees with the target 27 and that is not easy to react with the target 27.

The inner peripheries of the prevention part 284, the collection container 281, the cylinder part 285 of the second example of the target collector 28 shown in FIG. 8 may be coated with the coating material 287*a*. In this case, the entire inner peripheries of the prevention part 284, the collection container 281, and the cylinder part 285 of the target collector 28 may not necessarily be coated with the coating material 287*a*. Only the region of the target collector 28 against which the target 27 or the fragmented materials 274 collide(s) may be coated with the coating material 287*a*. The same may apply to the third to fifth examples of the target collector 28 shown in FIGS. 10 to 12.

The fifth example of the target collector 28 shown in FIG. 12 includes the receiving surface S of the pipe receiving part 286*a*, and therefore may not need to include the receiving part 283.

It would be obvious to a person skilled in the art that the technologies described in the above-described embodiments including the modifications may be compatible with each other.

For example, the filter 288 of the EUV light generation apparatus 1 according to Embodiment 3 shown in FIGS. 13A to 19C may be applicable to the target collector 28 of the EUV light generation apparatus 1 according to Embodiment 2 shown in FIGS. 8 to 12. Moreover, the exhaust hole 288*a* and the via-hole 288*b* shown in FIGS. 13B and 13C may be formed in the filter 288 of the EUV light generation apparatus 1 according to Embodiment 2 shown in FIGS. 8 to 12.

The descriptions above are intended to be illustrative only and the present disclosure is not limited thereto. Therefore, it will be apparent to those skilled in the art that it is possible to make modifications to the embodiments of the present disclosure within the scope of the appended claims.

The terms used in this specification and the appended claims should be interpreted as "non-limiting." For example, the terms "include" or "be included" should be interpreted as "including the stated elements but not limited to the stated elements." The term "have" should be interpreted as "having the stated elements but not limited to the stated elements." Further, the indefinite article "a/an" should be interpreted as "at least one" or "one or more."

REFERENCE SIGNS LIST

1 EUV light generation apparatus
2 chamber
26 target supply part

27 target
28 target collector
281 collection container
288 filter
5 EUV light generation controller
S receiving surface

The invention claimed is:

1. An extreme ultraviolet light generation apparatus comprising:

a chamber in which extreme ultraviolet light is generated when a target is irradiated with a laser beam inside the chamber;

a target supply part configured to supply the target into the chamber; and a target collector having an opening that faces the target supply part, and including a receiving surface having a contact angle of equal to or smaller than 90 degrees with the target, a liquid film of the target being formed on the receiving surface.

2. The extreme ultraviolet light generation apparatus according to claim 1, wherein an incidence angle θ of the target entering the receiving surface satisfies $0°<\theta<90°$.

3. The extreme ultraviolet light generation apparatus according to claim 1, wherein the target collector includes a temperature adjusting mechanism configured to adjust a temperature of the receiving surface to a temperature equal to or higher than a melting point of the target.

4. The extreme ultraviolet light generation apparatus according to claim 1, wherein the liquid film has a surface tension that allows the liquid film to absorb an impact force of a subsequent target incident on the receiving surface, and catch the subsequent target.

5. An extreme ultraviolet light generation apparatus comprising:

a chamber in which extreme ultraviolet light is generated when a target is irradiated with a laser beam inside the chamber;

a target supply part configured to supply the target into the chamber; and a target collector having an opening that faces the target supply part, and including a filter configured to allow the target to pass therethrough, and a receiving surface having a contact angle of equal to or smaller than 90 degrees with the target, a liquid film of the target being formed on the receiving surface.

6. The extreme ultraviolet light generation apparatus according to claim 5, wherein the filter prevents the target from dispersing to an outside of the target collector.

7. The extreme ultraviolet light generation apparatus according to claim 5, wherein the filter reduces a kinetic energy of the target.

8. The extreme ultraviolet light generation apparatus according to claim 7, wherein the filter reduces kinetic energy of the target by allowing the target to collide the filter and penetrate the filter.

9. The extreme ultraviolet light generation apparatus according to claim 8, wherein the filter is made with a porous metallic plate.

10. The extreme ultraviolet light generation apparatus according to claim 8, wherein the filter is made with wire netting.

11. The extreme ultraviolet light generation apparatus according to claim 8, wherein the filter is made with metallic foil.

12. The extreme ultraviolet light generation apparatus according to claim 11, wherein the filter is made with aluminium foil.

13. The extreme ultraviolet light generation apparatus according to claim 7, wherein the filter reduces kinetic energy of the target by allowing the target to collide the filter and deflect the filter to an inside of the target collector.

14. The extreme ultraviolet light generation apparatus according to claim 13, wherein the filter is formed by a fiber member.

15. The extreme ultraviolet light generation apparatus according to claim 14, wherein the filter is formed by a carbon fiber.

16. The extreme ultraviolet light generation apparatus according to claim 13, wherein the filter is formed by a curtain member.

17. The extreme ultraviolet light generation apparatus according to claim 5, wherein the target collector includes a temperature adjusting mechanism configured to adjust a temperature of the receiving surface to a temperature equal to or higher than a melting point of the target, and the liquid film has a surface tension that allows the liquid film to absorb an impact force of a subsequent target incident on the receiving surface, and catch the subsequent target.

* * * * *